US009468248B2

(12) United States Patent
Leon

(10) Patent No.: US 9,468,248 B2
(45) **Date of Patent: *Oct. 18, 2016**

(54) HELMET SYSTEM

(71) Applicant: Lionhead Helmet Intellectual Properties, LP, Ambler, PA (US)

(72) Inventor: Robert L. Leon, Ambler, PA (US)

(73) Assignee: Lionhead Helmet Intellectual Properties, LP, Ambler, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/921,582

(22) Filed: Oct. 23, 2015

(65) Prior Publication Data

US 2016/0037852 A1 Feb. 11, 2016

Related U.S. Application Data

(63) Continuation of application No. 14/809,561, filed on Jul. 27, 2015, which is a continuation of application No. 14/686,345, filed on Apr. 14, 2015, now Pat. No. 9,119,433, which is a continuation of application No.

(Continued)

(51) Int. Cl.
*A42B 3/00* (2006.01)
*A42B 3/06* (2006.01)
(Continued)

(52) U.S. Cl.
CPC ..... *A42B 3/064* (2013.01); *A42B 3/06* (2013.01); *A42B 3/08* (2013.01); *A42B 3/12* (2013.01); *A42B 3/121* (2013.01); *A42B 3/124* (2013.01); *A42B 3/125* (2013.01); *A63B 71/10* (2013.01)

(58) Field of Classification Search
CPC ..... A42B 3/125; A42B 3/08; A42B 2/121
See application file for complete search history.

(56) References Cited

U.S. PATENT DOCUMENTS 2,835,313 A 5/1958 Dodge
3,425,061 A 2/1969 Webb
(Continued)

FOREIGN PATENT DOCUMENTS

CN 101850638 A 10/2010
DE 4226588 A1 2/1994
(Continued)

OTHER PUBLICATIONS

Rowson et al., "Linear and Angular Head Acceleration Measurements in Collegiate Football," Journal of Biomechanical Engineering, Vo. 131, 7 pages (Jun. 2009).
(Continued)

*Primary Examiner* — Sally Haden
(74) *Attorney, Agent, or Firm* — Panitch Schwarze Belisario & Nadel LLP

(57) ABSTRACT

A protective helmet for successive impacts includes a head cap adapted to surround and move with a wearer's head and an outer shell which surrounds the head cap. An energy absorbing flexible liner predominantly comprised of radially oriented foam columns is attached to both the head cap and outer shell. The liner establishes a preset initial relative position and spacing between the head cap and the outer shell and compliantly absorbs energy imparted to the outer shell during a helmet impact to enable the outer shell to move linearly and angularly relative to the head cap during the helmet impact and to be returned to the initial relative position with the head cap following the impact.

8 Claims, 15 Drawing Sheets

Related U.S. Application Data

13/471,962, filed on May 15, 2012, now Pat. No. 9,032,558.

(60) Provisional application No. 61/519,441, filed on May 23, 2011.

(51) Int. Cl.

| | |
|---|---|
| ***A42B 3/12*** | (2006.01) |
| ***A42B 3/08*** | (2006.01) |
| ***A63B 71/10*** | (2006.01) |

(56) References Cited

U.S. PATENT DOCUMENTS

| | | | | |
|---|---|---|---|---|
| 3,877,076 | A | 4/1975 | Summers et al. | |
| 3,943,572 | A * | 3/1976 | Aileo | A42B 3/166 2/209 |
| 4,307,471 | A | 12/1981 | Lovell | |
| 4,534,068 | A | 8/1985 | Mitchell et al. | |
| 4,586,200 | A | 5/1986 | Poon | |
| 5,030,501 | A | 7/1991 | Colvin et al. | |
| 5,589,016 | A | 12/1996 | Hoopingarner et al. | |
| 5,815,846 | A | 10/1998 | Calonge | |
| 5,970,550 | A | 10/1999 | Gazes | |
| 6,070,271 | A | 6/2000 | Williams | |
| 6,070,905 | A | 6/2000 | Renault | |
| 6,219,850 | B1 | 4/2001 | Halstead et al. | |
| 6,298,497 | B1 | 10/2001 | Chartrand | |
| 6,308,490 | B1 | 10/2001 | Saebi | |
| 6,324,700 | B1 | 12/2001 | McDougall | |
| 6,453,476 | B1 | 9/2002 | Moore, III | |
| 6,658,671 | B1 | 12/2003 | Von Holst et al. | |
| 6,871,525 | B2 | 3/2005 | Withnall et al. | |
| 6,934,971 | B2 | 8/2005 | Ide et al. | |
| 6,968,575 | B2 | 11/2005 | Durocher | |
| 7,240,376 | B2 | 7/2007 | Ide et al. | |
| 7,367,898 | B2 | 5/2008 | Hawkins et al. | |
| 7,461,726 | B2 | 12/2008 | Hawkins et al. | |
| 7,603,725 | B2 | 10/2009 | Harris | |
| 7,676,854 | B2 | 3/2010 | Berger et al. | |
| 7,774,866 | B2 | 8/2010 | Ferrara | |
| 7,802,320 | B2 | 9/2010 | Morgan | |
| 7,832,023 | B2 | 11/2010 | Crisco | |
| 7,900,279 | B2 | 3/2011 | Kraemer et al. | |
| 7,930,771 | B2 | 4/2011 | Depreitere et al. | |
| 7,954,177 | B2 | 6/2011 | Ide et al. | |
| 7,954,178 | B2 | 6/2011 | Durocher et al. | |
| 8,015,624 | B2 | 9/2011 | Baldackin et al. | |
| 8,127,373 | B1 | 3/2012 | Fodemski | |
| 8,166,574 | B2 | 5/2012 | Hassler | |
| 8,191,179 | B2 | 6/2012 | Durocher et al. | |
| 8,196,226 | B1 | 6/2012 | Schuh | |
| 8,347,421 | B2 | 1/2013 | Krueger | |
| 8,365,315 | B2 | 2/2013 | Ortiz et al. | |
| 8,387,164 | B2 | 3/2013 | Maddux et al. | |
| 8,402,715 | B2 | 3/2013 | Uhllg et al. | |
| 8,578,520 | B2 | 11/2013 | Halldin | |
| 8,931,606 | B2 | 1/2015 | Hawkins et al. | |
| 8,955,169 | B2 | 2/2015 | Weber et al. | |
| 2001/0031350 | A1 | 10/2001 | Day et al. | |
| 2002/0023291 | A1 | 2/2002 | Mendoza | |
| 2003/0140400 | A1 | 7/2003 | Ho | |
| 2004/0117896 | A1 | 6/2004 | Madey et al. | |
| 2004/0250340 | A1 | 12/2004 | Piper et al. | |
| 2005/0246824 | A1 | 11/2005 | Berger et al. | |
| 2006/0031978 | A1 | 2/2006 | Pierce | |
| 2006/0059606 | A1 | 3/2006 | Ferrara | |
| 2006/0070170 | A1 | 4/2006 | Copeland et al. | |
| 2006/0112477 | A1 | 6/2006 | Schneider | |
| 2007/0068755 | A1 | 3/2007 | Hawkins et al. | |
| 2008/0066217 | A1 | 3/2008 | Depreitere et al. | |
| 2008/0155735 | A1 | 7/2008 | Ferrara | |
| 2008/0256685 | A1 | 10/2008 | Lampe et al. | |
| 2009/0000377 | A1 | 1/2009 | Shipps et al. | |
| 2009/0024406 | A1 | 1/2009 | Rawls-Meehan | |
| 2009/0151056 | A1 | 6/2009 | Desjardins et al. | |
| 2009/0218185 | A1 | 9/2009 | Lin | |
| 2009/0265839 | A1 | 10/2009 | Young et al. | |
| 2009/0320185 | A1 | 12/2009 | Hassler | |
| 2010/0005573 | A1 | 1/2010 | Rudd et al. | |
| 2010/0299812 | A1 | 12/2010 | Maddux et al. | |
| 2010/0319109 | A1 | 12/2010 | Field | |
| 2011/0072587 | A1 | 3/2011 | Cao et al. | |
| 2011/0107503 | A1 | 5/2011 | Morgan | |
| 2011/0117310 | A1 | 5/2011 | Anderson et al. | |
| 2011/0131695 | A1 | 6/2011 | Maddux et al. | |
| 2011/0171420 | A1 | 7/2011 | Yang | |
| 2011/0271427 | A1 | 11/2011 | Milsom | |
| 2011/0277221 | A1 | 11/2011 | Ide et al. | |
| 2012/0047635 | A1 | 3/2012 | Finiel et al. | |
| 2012/0096631 | A1 | 4/2012 | King et al. | |
| 2012/0143526 | A1 | 6/2012 | Benzel et al. | |
| 2012/0151663 | A1 | 6/2012 | Rumbaugh | |
| 2012/0151664 | A1 | 6/2012 | Kirshon | |
| 2012/0186003 | A1 | 7/2012 | Heger et al. | |
| 2012/0192337 | A1 | 8/2012 | Divine et al. | |
| 2012/0198604 | A1 | 8/2012 | Weber et al. | |
| 2012/0198605 | A1 | 8/2012 | Maddux et al. | |
| 2012/0204329 | A1 | 8/2012 | Faden et al. | |
| 2012/0207964 | A1 | 8/2012 | Faden et al. | |
| 2012/0208032 | A1 | 8/2012 | Faden et al. | |
| 2012/0216339 | A1 | 8/2012 | Nimmons et al. | |
| 2012/0233745 | A1 | 9/2012 | Veazie | |
| 2012/0266365 | A1 | 10/2012 | Cohen | |
| 2012/0266366 | A1 | 10/2012 | Ferrara | |
| 2012/0297525 | A1 | 11/2012 | Bain | |
| 2012/0304367 | A1 | 12/2012 | Howard et al. | |
| 2012/0317705 | A1 | 12/2012 | Lindsay | |
| 2012/0324634 | A1 | 12/2012 | Coyle | |
| 2013/0000016 | A1 | 1/2013 | Hall et al. | |
| 2013/0000017 | A1 | 1/2013 | Szalkowski et al. | |
| 2013/0000018 | A1 | 1/2013 | Rudd et al. | |
| 2013/0007950 | A1 | 1/2013 | Arai | |
| 2013/0019384 | A1 | 1/2013 | Knight | |
| 2013/0019385 | A1 | 1/2013 | Knight | |
| 2013/0025031 | A1 | 1/2013 | Laperriere et al. | |
| 2013/0025032 | A1 | 1/2013 | Durocher et al. | |
| 2013/0025033 | A1 | 1/2013 | Durocher et al. | |
| 2013/0036531 | A1 | 2/2013 | Belanger et al. | |
| 2013/0040524 | A1 | 2/2013 | Halldin et al. | |
| 2013/0042397 | A1 | 2/2013 | Halldin | |
| 2013/0055488 | A1 | 3/2013 | Garneau | |
| 2013/0061371 | A1 | 3/2013 | Phipps et al. | |
| 2013/0061372 | A1 | 3/2013 | Goldstein | |
| 2013/0061375 | A1 | 3/2013 | Bologna et al. | |
| 2013/0111654 | A1 | 5/2013 | Gorsen et al. | |
| 2013/0122256 | A1 | 5/2013 | Kleiven et al. | |
| 2013/0185837 | A1 | 7/2013 | Phipps et al. | |
| 2013/0254978 | A1 | 10/2013 | McInnis et al. | |
| 2014/0096311 | A1 | 4/2014 | Halldin | |
| 2014/0170372 | A1 | 6/2014 | Fink | |
| 2015/0000018 | A1 | 1/2015 | Brandt | |

FOREIGN PATENT DOCUMENTS

| | | | |
|---|---|---|---|
| EP | 1142495 | A1 | 10/2001 |
| WO | 2004032659 | A1 | 4/2004 |

OTHER PUBLICATIONS

Broglio et al., "Biomechanical Properties of Concussions in High School Football," Medicine and Science in Sports Exercise; www.medscape.com, pp. 1-10, (Nov. 23, 2010).

Greenwald et al., "Head Impact Telemetry System (HITSTM) for Measurement of Head Acceleration in the Field," American Society of Biomechanics—2003 Annual Meeting, 2 pages.

Daniel et al., "Head Impact Exposure in Youth Football," Annals of Biomedical Engineering, 6 pages (Feb. 15, 2012).

ASTM F 1446-04, "Standard Test Methods for Equipment and Procedures Used in Evaluating the Performance Characteristics of Protective Hedgear," ASTM International, pp. 1-11 (date: unknown).

(56) References Cited

OTHER PUBLICATIONS

"Head Injuries in Football," The New York Times, pp. 4 (Nov. 16, 2011).
Rousseau et al., "A Comparison of Peak Linear and Angular Headform Accelerations Using Ice Hockey Helmets," Journal of ASTM International; www.astm.org, vol. 6, No. 1, 11 pages (Feb. 20, 2009).
Rowson et al., "Development for the STAR Evaluation System for Football Helmets: Integrating Player Head Impact Exposure and Risk of Concussion," Annals of Biomedical Engineering, 11 pages (May 7, 2011).
Rousseau et al., "The Influence of Deflection and Neck Compliance on the Impact Dynamics of a Hybrid III Headform," Proceedings of the Institution of Mechanical Engineers, vol. 223, Part P: J. Sports Engineering and Technology, pp. 89-97 (Apr. 3, 2009).
"2011 Concussion Report—End of Regular Season," 4 pages (Jan. 10, 2012).
Shipley, "Traumatic Brain Injury and Diffuse Axonal Injury," Trial Image Inc.; www.trialimagestore.com, pp. 1-5 (Feb. 18, 2011).
Newman et al., "A New Biomechanical Assessment of Mild Traumatic Brain Injury Part 2—Results and Conclusions," 11 pages, (date: unknown).
King et al., "Is Head Injury Caused by Linear or Angular Acceleration?," IRCOBI Conference, pp. 1-12 (Sep. 2003).
NOCSAE DOC (ND) 001-11M11, "Standard Test Method and Equipment Used in Evaluating the Performance Characteristics of Protective Headgear Equipment," NOCSAE/National Operating Committee on Standards for Athletic Equipment, pp. 1-25 (Jan. 2012).
NOCSAE DOC (ND) 002-11m11a, "Standard Performance Specification for Newly Manufactured Football Helmets," NOCSAE/National Operating Committee on Standards for Athletic Equipment, pp. 1-6 (Feb. 2012).
"NOCSAE receives $1.1M Research Grants to Advance Science of Sports Medicine," 2 pages (Jun. 20, 2011).
"Helmet Safety Group Approves Research Grants," SFGate.com, 1 page (Jun. 18, 2011).
Bartholet, "The Collision Syndrome," Scientific American, pp. 68-71 (Feb. 2012).
Kluger, "Headbanger Nation. Concussions are clobbering U.S. kids. Here's why," Time Magazine, pp. 42-51 (Jan. 31, 2011).
"Concussion," Wikipedia, 17 pages (page last modified on May 21, 2012).
Int'l Search Report issued Aug. 8, 2012 in Int'l Application No. PCT/US12/38337; Written Opinion.
Int'l Preliminary Report on Patentability issued Aug. 13, 2013 in Int'l Application No. PCT/US2012/038337.
Office Action issued Aug. 14, 2013 in U.S. Appl. No. 13/471,962.
Office Action issued Aug. 14, 2013 in U.S. Appl. No. 13/868,699.
Office Action issued Dec. 13, 2013 in U.S. Appl. No. 13/868,699.
Office Action issued Dec. 11, 2013 in U.S. Appl. No. 13/471,962.
Office Action issued May 27, 2014 in U.S. Appl. No. 13/471,962.
Extended European Search Report issued Jun. 23, 2015 in EP Application No. 12789200.8.
Office Action issued Aug. 10, 2015 in U.S. Appl. No. 14/709,959 by Leon.
"Frustoconical," Wiktionary, N.p., n.d. Web. Aug. 4, 2015.
"Frustum." Wiktionary. N.p., n.d. Web. Aug. 4, 2015.
Office Action issued Mar. 11, 2016 in U.S. Appl. No. 14/809,439 by Leon.
"EZ Dri." INOAC. INOAC, n.d. Web Mar. 2, 2016.
"Outdoor Foam Cushion, Waterproof Foam, Patio Cushion, Furniture Cushions." Outdoor Foam Cushion, Waterproof Foam, Patio Cushion, Furniture Cushions. N.p., n.d. Web Mar. 2, 2016.

* cited by examiner

Geodesic 5V 8/15 Icosahedron Dome Pattern

HELMET SYSTEM

CROSS-REFERENCE TO RELATED APPLICATIONS

This application is a continuation of U.S. patent application Ser. No. 14/809,561 filed Jul. 27, 2015, which is a continuation of U.S. patent application Ser. No. 14/686,345, filed Apr. 14, 2015, now U.S. Pat. No. 9,119,433, issued Sep. 1, 2015, which is a continuation of U.S. patent application Ser. No. 13/471,962, filed May 15, 2012, now U.S. Pat. No. 9,032,558, issued May 19, 2015, which claimed priority to U.S. Provisional Patent Application No. 61/519,441, filed May 23, 2011, the disclosures of which are incorporated herein by reference.

BACKGROUND OF THE INVENTION

The present invention relates generally to helmets, particularly helmets used to protect the head of a user participating in sports, such as football, or other activities. More particularly, the present invention comprises an improved helmet system for protecting a user from sustaining concussions and other head injuries.

A key function of sports helmets and football helmets in particular, is to reduce the occurrence of brain concussions. Concussion is the term used for mild traumatic brain injuries, MTBIs for short. Despite the "mild" descriptor, concussions are serious injuries and their effect if more than one is experienced by a player become cumulative and may lead to chronic traumatic encephalopathy, or CTE, with reduced brain function in later life. Plus recent evidence indicates that those with CTE may be fifty times more likely to get amyotrophic lateral sclerosis, or ALS, than the average population (Scientific American, February 2012). The problem today has become nearly epidemic—with an estimated 300,000 football concussions a year among youth, high school, college, and NFL players. Moreover, due to players concealing their injuries and coaches and trainers failing to detect them, many experts believe that number could be low by a factor of two. To counter the concussion problem, the NFL, the colleges, and the helmet manufacturers have attempted some or all of the following: improving the helmet designs; enforcing harsh penalties and severe fines for spearing or other intentional helmet to helmet contacts; identifying concussed players and keeping them sidelined long enough for symptoms to fully subside (sometimes several weeks); trying to better quantify the peak linear and angular acceleration levels of the skull that can lead to concussions; and in a combination of the latter two, measuring the accelerations in real time utilizing multiple miniature accelerometers located against the skull inside the helmets, with the skull acceleration waveforms being transmitted in real time to the sidelines so any player receiving a potential concussion level impact can be immediately identified and removed from the game to be administered predetermined concussion symptom checks, a test which the player must pass before being allowed to reenter the fray. A significant effort has also been made to come up with an optimum metric for characterizing skull impact levels that would accurately predict a resulting concussion. This task began several years ago with the severity index, SI; then the head impact criteria HIC; then head impact power HIP; and most recently the brain impact criteria, BIC and others. However, none of these metrics has yet been shown to be significantly more successful at predicting a concussion than the combination of the maximum linear acceleration value and the maximum angular acceleration value, where the current NFL threshold value being used for the former is 79 Gs, and the current NFL threshold value being used for the latter is 5,757 radians/second$^2$.

Despite recent helmet improvements (mostly better cushioning in the liner area to better reduce head acceleration levels), concussions seem to continue unabated, so the various helmet improvements have not significantly helped to reduce the number of occurrences. One likely reason for the lack of success in reducing concussions is that the helmet improvements made so far have mostly concentrated on the linear acceleration issue, and have mostly or completely ignored the angular acceleration issue.

The lack of real reductions in concussions may be the result of a simple misconception about what goes on inside the head to cause a concussion. The simplified view is that when the skull is stopped too abruptly, in say a frontal impact, the brain continues on to strike the inside of the skull at the front, and if the impact is severe enough the brain can even rebound and strike the inside of the skull at the rear. The former is termed a coup injury and the latter a contrecoup injury. As a result of the above simple explanation, the main object in making helmet improvements has been to stop the skull less abruptly, i.e., taking steps to reduce its linear deceleration. That is what most of the recent helmet improvements have concentrated on doing. Yet it will be herein shown that nature's own thin layer of cerebrospinal fluid or CSF between the brain and the inside of the skull is extremely effective through its buoyancy effect in mitigating the envisioned impact between the brain and the front of the skull in an abrupt linear stop, even at head deceleration levels that greatly exceed 79 Gs. So, contrary to current thinking, high linear acceleration, or deceleration, does not provide the entire picture, and one needs to look further, particularly at the angular acceleration of the head.

But angular acceleration is not part of that simplified picture of what happens to the brain in a concussion, so it tends to get ignored. And yet, unlike with linear acceleration, the cerebrospinal fluid is not as effective in eliminating damaging internal impacts of the brain against the inside of the skull in response to an abrupt high angular acceleration of the head. Two contributors to angular acceleration are herein identified which may either add or subtract depending on the direction of the impact and its location, both with respect to the neck position as will be discussed below. Limiting the linear acceleration or deceleration of the head, which current helmet designs do fairly effectively, is helpful in limiting the first contributor to angular acceleration, which is the pendulum motion of the head and neck together. But the current helmet designs do little or nothing to limit the second contributor to angular acceleration, which is the rotational motion of the head at the top of the neck. If this second contributor to angular acceleration could be limited as well, it would go a long way toward reducing the high levels of angular acceleration that appear to lead to concussions. Indeed, the field data show that without this second contributor to angular acceleration, most of the current concussion level football impacts would fall short of the accepted threshold concussion level for angular acceleration. Accordingly, the overall number of football concussions may be significantly reduced if a new helmet design that could additionally significantly lower this second angular acceleration contributor were to be widely implemented.

Note that regarding the terminology used in the preceding and following discussion and throughout the specification, on occasion the terms acceleration and deceleration are used within their specific intended meanings, but usually the two terms may be interchanged, so when the term acceleration is used it applies equally well to a deceleration and vice versa. Also, within the specification, the terms angular, rotational, circumferential, tangential, and lateral are often used interchangeably, as are the terms linear, radial, centered, straight-on, and normal. The term off-center refers to any direction between centered and tangential. Finally, the terms radial and radially should be interpreted as meaning substantially radial, as it usually relates to a non-spherical surface (object) such as a spheroid, ellipsoid, or ovoid surface.

To understand how the present invention addresses the concussion problem, it is helpful to first review the results of some comprehensive in-situ football data. In a study conducted by Virginia Tech in 2007, and reported on by Rowson, et al, in the Journal of Biomechanical Engineering, June 2009, Vol. 131, ten six-degree-of-freedom (6DOF) instrumented helmets were used to collect data during both practices and games on offensive and defensive linemen. These biggest players wear the largest helmets which are able to accommodate the instrumentation. Each 6DOF system consists of 6 dual axis micro-electro-mechanical-system (MEMS) accelerometers for a total of 12 independent outputs (a minimum of 9 are needed in a 3,2,2,2 configuration so the extra 3 outputs provide for some redundancy) installed in a Riddell Revolution model football helmet (a recent design for concussion avoidance), a wireless transceiver, and an on-board memory for up to 120 impacts with 8 bit resolution data being acquired continuously at a sample rate of 1,000 Hz per channel. A data set was triggered and saved when any accelerometer experienced an impact level of 10 Gs or more. Impact data sets are 40 milliseconds long (8 ms pre-trigger and 32 ms post-trigger). All of the saved data was transmitted to the sidelines by a commercial computerized helmet impact transmission system, called HITS, to be further analyzed. All of the MEMS miniature accelerometers were held tightly against the skull of the helmet wearer by the foam padding of the helmet to help insure good skull motion data, and the raw data was combined in the following coordinate system: The positive x-axis is directed out of the face (perpendicular to the coronal plane), the positive y-axis is directed out of the right ear (perpendicular to the midsagittal plane), and the positive z-axis is directed out of the bottom of the head (perpendicular to the transverse plane). The origin approximates the center of gravity (e.g.) of the head.

In all, 1712 impacts were recorded, 570 during games, 1142 during practices. Although 11 peak linear accelerations exceeded 80 g and 12 peak angular accelerations exceeded 6,000 rad/sec$^2$, no instrumented player sustained a concussion during the 2007 season. The maximum recorded peak linear acceleration was 135 g and the maximum recorded peak angular acceleration was 9,222 rad/sec$^2$, each over 50% more than accepted NFL threshold values. However, in other studies, players who experienced lower values than the NFL threshold values did sustain concussions. Clearly, the situation is far more complex than just the levels of peak acceleration.

FIG. 1 shows an average linear acceleration response in the Virginia Tech in-situ data. The average peak acceleration value was 23 g and all the acceleration/deceleration waveforms lasted approximately 14 milliseconds as shown. For the larger accelerations (and the larger angular accelerations), the timing remained approximately the same.

FIG. 2 shows a scatter plot of the change in linear velocity of the head vs. peak linear acceleration for all of the impacts. Only a few impacts represented a change in velocity of up to 20 ft/sec and the vast majority of the rest were less than half that value. Despite a slight offset about the origin, note the approximate linear relationship between change in velocity and peak linear acceleration.

FIG. 3 shows a scatter plot of the change in angular velocity of the head vs. peak angular acceleration for all of the impacts. Again note the approximate linear relationship.

FIG. 4 shows a scatter plot of peak angular acceleration vs. peak linear acceleration for all of the impacts. Note that each impact results in both a linear and an angular acceleration. The reference line is 4,300 rad/sec$^2$ per 100 Gs. But there is little evidence of linearity or correlation between the two accelerations. That is, there can be high angular acceleration at the same time as low linear acceleration, and vice versa. How this can physically happen provides the clue for how to keep the peak angular acceleration value below the concussion threshold value in most cases. As will be discussed, the peak angular acceleration value is what is most damaging to the brain, but the peak linear acceleration value, although not particularly damaging in its own right, is still very important in its role as a contributor to the peak angular acceleration. This apparent dichotomy with respect to the role of peak linear acceleration has likely led to the confusion that's existed among current researchers trying to determine the significance of peak linear and angular accelerations in concussions.

Before attempting to fully understand FIG. 4, we need to first explore the head, neck, and body connection. In all head impact cases the forces and torques that eventually halt the impulsive and inertial motions of the head must arise from the more massive body and these forces and torques come through the neck. If the neck were so rigid that the head could not move at all with respect to the massive body, it would be unlikely that any football player could receive enough linear or angular acceleration to cause a concussion. Thus one can assume the stronger the neck connection to that massive body (the stronger the neck muscles), the lesser the impulsive inertial motions of the head will be. That may be why professional football players, who have stronger necks than high school players, do not suffer proportionally more concussions even though they are hit harder. Also, the striking (hitting) players in a collision appear to suffer fewer concussions than the struck (hit) players and one reason might be because the striking players may have tensed their neck muscles in preparation for the impact while the struck players may be caught unawares. Another reason is presented later when it can be better understood.

But since no football player's neck is totally rigid, the allowed motions need to be considered to better understand FIG. 4, with its non-correlating angular and linear acceleration levels. The neck contains seven cervical vertebrae that connect the skull to the thoracic vertebrae and the rest of the body. The neck can curve one way at the top by the head and another way at the bottom where it joins the more massive body. At the bottom, the neck can bend forward toward the chest or backward toward the back, and also it can bend toward the right shoulder or toward the left shoulder. At the top of the neck (pivoting at about ear level as viewed from the side), the head may independently rotate in any of three planes: first, the shaking of one's head in a vertical midsagittal plane "yes" motion; second, the shaking of one's head in a horizontal transverse plane "no" motion; and third, the cocking of one's head left or right in a vertical coronal plane. As will be shown below, the independent rotation of the head at the top of the neck is the main reason for seeing wildly different angular and linear accelerations in a given impact.

Based on the above-described allowed head-neck motions, in order to analyze what is going on it is useful to envision the head-neck system as an "apple-on-a-stick," where the stick (the neck) is able to pivot in two directions (forward and backward and side to side) at its base (where it joins the body) thereby enabling a sort of pendulum motion, and the apple (the head) is able to pivot in all three directions at the top of the stick (in other words: at the top of the neck, at about ear height) thereby enabling an additional rotational motion of just the head. The first motion (the head-neck pendulum motion) contributes to both the linear and the angular acceleration of the head, while the second motion (the rotational motion of just the head at the top-of-the-neck) contributes mostly to just the angular acceleration of the head. These two contributors to angular acceleration, when existing in the same plane, may either add or subtract depending on the direction of the impact and its location, as will be discussed below. When in different planes, the two contributors to the total head angular acceleration also combine but not in a direct fashion. Limiting the linear acceleration or deceleration of the head in response to an impact, which current helmet designs do fairly effectively, is helpful in also limiting the first contributor to head angular acceleration, the head-neck pendulum motion. But current helmet designs do very little to limit the second contributor to head angular acceleration, the independent top-of-the-neck rotational motion of the head. That fact is evidenced by how easily a player's head can be jerked around, for example, when another player yanks his face-mask.

It is a fundamental assertion of the present invention that high angular acceleration of the head is the primary causer of brain injury in a head impact, and, conversely that high linear acceleration of the head is not the main injury causer, except through its contribution to head angular acceleration via the previously described head-neck pendulum motion. At the heart of this assertion largely vindicating linear acceleration is the contention that, contrary to popular belief, when the skull is suddenly stopped in a helmet-to-helmet collision, the brain does not continue on unimpeded to crash against the inside of the skull in the direction of the impact, then to potentially rebound to crash against the inside of the skull in the opposite direction as well. Moreover, this contention is a fact, as will be shown in the following paragraphs.

It was previously stated, without supporting evidence, that the buoyancy of the brain in the surrounding cerebrospinal fluid is very effective in eliminating an impact of the brain against the inside of the skull wall (the cranium) in very high linear acceleration and deceleration (impact) situations. The following examples and discussion provide the supporting evidence to confirm the foregoing statement.

Picture a car crashing head-on into a concrete wall. The car's inhabitants (assuming no seat belts and no air bags) will continue to move forward until they smash into one or more of the inside structures of the car (dashboard, windshield, etc.) That is how a concussion is typically described, where the skull plays the role of the car and the brain plays the role of its inhabitants. However, what if the car were filled with water instead of air, and the inhabitants (now properly fitted with SCUBA gear) are neutrally buoyant in the water, like the brain is approximately neutrally buoyant in the surrounding cerebrospinal fluid. Now upon the collision of the car into the immoveable wall, the car, the water, and the inhabitants all come to a stop in short order and none of the inhabitants smash into the windshield or other interior car surfaces. Why?

By the well proven Equivalence Principle in physics, inside a small windowless room in outer space nothing can tell the difference between an acceleration/deceleration force and a gravity force. Thus, if the deceleration of the car were a constant 1 G, that would be equivalent to simply standing the car on end, front side down, on Earth. In that case, all of the inhabitants in the water-filled car would remain as neutrally buoyant as they were before, suspended in-place like a submarine in the ocean, and no one would crash downward into the windshield or other interior surfaces of the car. If the deceleration were a constant 100 Gs, that would be equivalent to standing the car on end on a planet with 100 times the gravity of Earth, and again everyone would remain neutrally buoyant, suspended in-place, and no one would crash into the windshield. Physically, a linear pressure gradient is formed in the water. On the 1 G Earth, in every body of water, no matter how big or how small, the linear pressure gradient goes from zero at the top surface (plus atmospheric pressure) to a pressure at the bottom equal to the weight density of the water (its mass density times the acceleration of gravity) times the depth of the water (plus atmospheric pressure). For a neutrally buoyant object in the water, the effective pressure gradient (along the object) times the effective area of the object (acted on by the pressure gradient) exactly counters its weight (its mass times the acceleration of gravity). At 100 Gs, the weight of the object is 100 times as much, but the weight density of water is also 100 times as much so the effective pressure gradient is 100 times as much and the object remains neutrally buoyant, and stationary. This is equivalent to what happens under acceleration.

It is not necessary to just accept this at face value. It can be verified experimentally using a 1 inch diameter solid polystyrene ball which has a specific gravity of 1.040, and a 5.5% saline solution of water which has a specific gravity of 1.040 at 68° F. Place the ball and saline solution in a 2 inch diameter transparent hard plastic tube closed and sealed at both ends. Make sure all the air bubbles have been removed. Then with the ball suspended in the middle of the tube, smack the tube axially into a hard stationary surface as hard as possible and observe how the ball moves. See if the ball which represents a neutrally buoyant brain, suspended in the saline solution which represents the cerebrospinal fluid, crashes into the front impact surface of the tube representing the inside of the skull. It should not. Indeed if what has been stated above is correct—and it is—the neutrally buoyant ball should not move at all—and it doesn't.

When talking about the brain, however, the brain is not exactly neutrally buoyant in the surrounding cerebrospinal fluid. It is about 3% more dense than the fluid. So the brain will continue to move forward when the forward-moving skull is abruptly decelerated to a stop, but by how much and with what remaining velocity?

Picture a non-helmeted man running through a darkened space with his head held well forward when suddenly his head strikes a wall while he's running at, for example, 10 ft/sec (which is about an 8 minute mile pace). The key constraint in this example is that the orientation of the man's skull remains unchanged throughout the process, so that there is no angular acceleration. Also, it is assumed the man is fortunate enough to not break his neck, nor fracture his skull, but his skull's limited elasticity when combined with the stiffness of the wall will stop his skull in (say) just 2 milliseconds (a reasonable assumption). We can further simplify the analysis by assuming, in addition, that the deceleration of his skull is constant over those 2 milliseconds, and with that assumption the resulting calculated deceleration will be 155.3 Gs. Note that the peak deceleration would be higher without that assumption.

Now what happens to the man's brain at the same time? His brain weighs about 3.1 lbs and approximates a 6.8 inch long top-half semi-ellipsoid or ovoid. The weight density of his brain is about 0.0375 lbs/in$^3$, and the weight density of the cerebrospinal fluid which surrounds it is about 0.0364 lbs/in$^3$. The cerebrospinal fluid CSF decelerates along with the skull resulting in a linear pressure gradient in the CSF (for those 2 milliseconds) that ranges from zero psi gauge pressure at the back of the brain to 38.4 psi gauge pressure at the front of the brain where the skull was impacted (6.8×0.364×155.3=38.4). Thus, acting upon each small segmental surface area of the brain, there is a front/back force on that brain area segment equal to the front/back projection of the area segment times the gauge pressure at that location. This calculation yields a resultant decelerating force of 466.5 lbs. with the resulting deceleration of the 3.1 lb brain being 150.5 Gs. Thus the brain is significantly slowed along with the skull, but not quite as much as the skull.

The distance the man's skull travels during the deceleration is:

$$d_{sk}=V_0t-\tfrac{1}{2}a_{sk}t^2 \quad \text{(Equation 1)}$$

where $V_0$=10 ft/sec; t=2 msec; $a_{sk}$=155.3 Gs→$d_{sk}$=0.120 inches

The distance his brain travels during the deceleration is:

$$d_{br}=V_0t-\tfrac{1}{2}a_{br}t^2 \quad \text{(Equation 2)}$$

where $V_0$=10 ft/sec; t=2 msec; $a_{br}$=150.5 Gs→$d_{br}$=0.124 inches

Thus during those 2 milliseconds of deceleration, the man's brain closes the gap between itself and the front of his skull by only 0.004 inches (about the thickness of a piece of paper). The initial gap is about 0.100 inches (approximately 2.5 mm), consisting of the outer hard dura mater layer, the inner soft pia mater layer which covers the brain, and the filament-like arachnoid layer and the CSF-filled subarachnoid space in between.

So, at the end of the 2 millisecond skull deceleration period, the speed of the man's skull is 0 ft/sec and the speed of his brain is all the way down to 0.31 ft/sec (from 10 ft/sec). In terms of energy, due to kinetic energy's speed squared relationship, 99.9% of his brain's initial kinetic energy has already been dissipated, leaving just 0.1% of its initial kinetic energy to yet be dissipated. Since the cerebrospinal fluid is no longer decelerating to provide a decelerating force through an acceleration induced linear pressure gradient, the deceleration must be accomplished by squeezing more of the cerebrospinal fluid out of the remaining 0.096 inch space and compressing the compressible pia mater and arachnoid layer. The remaining required deceleration of 0.19 Gs, which corresponds to a decelerating force of only 9.3 ounces, is not very likely to be damaging.

Before knowing the above analysis one would have assumed that a 155 G deceleration impact on the skull would certainly cause a concussion. In light of the above analysis, however, that seems to no longer be the case, even for a head deceleration level more than two times what the NFL considers to be the linear acceleration/deceleration threshold level for concussions (79 Gs). Why then does a high peak linear acceleration level of the head matter? (Recall that in the above example, the orientation of the cranium was held constant, so there was no angular acceleration of the head.)

For real-life impacts, however, high linear acceleration levels usually do matter because through the previously described head-neck pendulum motion, the linear acceleration of the head also contributes to the angular acceleration of the head. When the linear acceleration component perpendicular to the neck at the c.g. of the head (located about 8 inches from the lower neck pivot) is at a level of 79 Gs, its contribution to the resulting angular acceleration of the head is 3,816 rad/sec$^2$. That is just two-thirds of the NFL threshold angular acceleration level of 5,757 rad/sec$^2$. Moreover, only rarely will a measured 79 G peak linear acceleration level occur in a direction perpendicular to the neck (at the c.g. of the head), so in order to attain a 79 G perpendicular component the total peak linear acceleration level would normally need to be even higher. But in order to reach the angular acceleration concussion level, there will usually need to be not just a high peak linear acceleration level (to yield a reasonably high angular acceleration value through the head-neck pendulum effect), there needs to also be a significant and additive head rotational acceleration component present as well. This is the previously mentioned top-of-the-neck second head rotational acceleration component—the one the present invention attempts to further reduce.

To reinforce all the above and put the numbers in prospective, a second football study is presented. This study, reported on by Broglio, et al, in Medicine and Science in Sports and Exercise, 2010, followed 78 high school football players wearing Riddell Revolution helmets instrumented with the previously described Head Impact Telemetry System, (HITS) through four seasons of practices and games from 2005 to 2008. In all, 54,247 impacts were recorded (the impacts triggered whenever one of the accelerometer channels from the six dual axis units exceeded a threshold of 15 Gs). The data included 13 impacts that resulted in concussions. The recorded average peak linear acceleration levels were about 26 Gs, and the average peak angular acceleration levels were about 1,600 rad/sec$^2$, very similar to the previously cited data. But this study is more valuable because it includes data from actual concussion-causing impacts. From the data, the authors developed a concussion predictor "tree." The tree starts off not surprisingly with an angular acceleration threshold question.

1$^{st}$ Question: Angular Acceleration >5, 582 rad/sec$^2$
Answers: (No—53,563 impacts, 0 concussions)—0%
(Yes—684 impacts, 13 concussions)—1.9%
↓ (yes)
2$^{nd}$ Question: Linear Acceleration >96 Gs
Answers: (No—525 impacts, 2 concussions)—0.4%
(Yes—159 impacts, 11 concussions)—6.9%
↓ (yes)
3$^{rd}$ Question: Impact location; front, side, top
Answers: (No—77 impacts, 0 concussions)—0%
(Yes—82 impacts, 11 concussions)—13.4%
↓ (yes)
4$^{th}$ Question: Angular Acceleration <8,845 rad/sec$^2$
Answers: (No—35 impacts, 1 concussion)—2.9%
(Yes—47 impacts, 10 concussions)—21.3%
↓ (yes)
5$^{th}$ Question: Linear Acceleration <102 Gs
Answers: (No—38 impacts, 5 concussions)—13.2%
(Yes—9 impacts, 5 concussions)—55.6%

For the 13 concussion causing impacts, the key metric was the resultant peak angular acceleration level. A minimum level of 5,582 rad/sec$^2$ was the indicated value, but the mean level was 7,229 rad/sec$^2$. The indicated minimum level of angular acceleration was a necessary, but not sufficient condition for the 13 concussive impacts (out of 54,247 impacts). From the standpoint of identifying better helmet protection, identifying a necessary condition is paramount, but from the standpoint of identifying a predictive metric, the necessary condition is not enough. In other words, 98% of the time (671 times out of 684 times), a player who received an angular acceleration greater than 5,582 rad/sec$^2$ did not suffer a concussion. So angular acceleration is a poor predictor. However, no player suffered a concussion as a result of receiving any of the 53,563 impacts where the angular acceleration level was less than 5,582 rad/sec$^2$. That is a powerful protection identifier—i.e., to simply incorporate a protective measure that will keep the head angular acceleration level below 5,582 rad/sec$^2$ as much as possible.

A key point previously made, now bears repeating. For those special cases that exhibit no local rotation of the head at the top of the neck, (envisioning all the motion of the head as just a pendulous apple on a stick pivoting at the base of the neck), a linear acceleration of the head still results in an angular acceleration of the head. For a=79 G, and r=8 inches, angular acceleration a=3,816 rad/sec$^2$. So for this very simplified case, a supposed concussion level for linear acceleration does not result in a concussion level for angular acceleration. To reach the concussion level for angular acceleration, there must also be a local angular acceleration (one that causes a local rotation of the head at the top of the neck) that adds to the above pendulum angular acceleration and the total combined angular acceleration value is the true culprit. The fact that in the first study's data (the college study), the measured angular accelerations were all over the map as compared to the measured linear accelerations (FIG. 4) is proof that local rotational accelerations of the head of the same order of magnitude as the head-neck pendulum head angular accelerations exist, and may occasionally fully add or fully subtract from the latter. From the above numbers, without the local angular acceleration contributor (to rotate the head at the top of the neck) it would take a pure 120 G linear acceleration to result in a pendulum angular acceleration that exceeds the 5,757 rad/sec$^2$ NFL threshold concussion value. Thus it should be clear that if the local rotational angular acceleration contributor could be eliminated (or significantly reduced) by the design of the helmet, then the pendulum angular acceleration all by itself would rarely be able to cause a concussion in a helmeted football player.

All of the concussed high school football players in the study not only received high resultant peak angular acceleration levels but also high resultant peak linear acceleration levels (the lowest was 74 Gs). But apparently many received the latter without the former and did not get concussions. The mean resultant peak linear acceleration level for the concussed players was 105 Gs. Assuming an average angle of 45° with the neck for the impact direction, and with the cosine of 45°=0.707, that would yield an average component perpendicular to the neck axis of 74 Gs, which by the previously described head-neck pendulum motion would yield a corresponding peak angular acceleration level of 3,575 rad/sec$^2$. That is approximately half the indicated mean level of 7,229 rad/sec$^2$ which the concussed players received, so on average, only about half the resultant peak angular acceleration for those 13 concussed players is the result of the linear acceleration acting through the head-neck pendulum motion. The other half—at least another 3,600 rad/sec$^2$ on average—must have come from the purely rotational acceleration of the head at the top of the neck that the present invention is intended to reduce.

A head angular acceleration threshold has been identified below which players seem not to get a concussion. Yet above that threshold they get a concussion only 2% of the time. Why? Does the cerebral spinal fluid CSF still play some sort of protective role for angular acceleration as it does for linear acceleration?

It was previously shown how the brain's near-buoyancy in the CSF causes a rapid pressure gradient rise in the CSF in synch with and proportional to the skull's rise in linear acceleration/deceleration, with the maximum pressure occurring at the impact location, and it was also shown that the pressure gradient increase causes an almost matching acceleration/deceleration of the brain, so no significant impact of the brain occurs against the inside of the skull. Indeed, researchers using tiny pressure transducers implanted in the brains of cadavers for head impact tests have recorded pressure waveforms near the impact location that exactly match the linear acceleration waveforms of the decelerating skull. Some researchers, who did not appreciate the fact that what they were recording was the brain's protective mechanism against linear acceleration, have conjectured that perhaps the rapid pressure increase is the damaging mechanism. But studies have shown that the brain is not damaged by compression, only by stretching, shearing, or twisting. Since the brain is not being bounced back and forth as commonly pictured, it must be the sudden rotation of the head that is causing the cranium (the portion of the skull that surrounds the brain) to impact the brain at one or more locations which results in that stretching or twisting. However, because the cranium and the brain are not spherical, but instead semi-ovoid and oblong, at the oblong extremities an angular acceleration can resemble a transverse linear acceleration and as a result the CSF can experience quasi-linear acceleration induced pressure gradients at the oblong extremities which tend to gently (over a wide surface area) rotate the near neutrally buoyant brain along with the cranium, and so the CSF is still partially protective against angular acceleration induced internal impacts, just not nearly as effectively as for pure linear accelerations. Just how protective this will be can depend on a host of factors including but not limited to: the cranium and brain's different oblong nature in the different axes, individual physical shape differences, how the brain's undulating surface high regions and low regions line up with the major angular acceleration axis, and how variations in the thickness of the CSF layer locally line up at potential rotational impact points. With all that variability, it is perhaps not surprising that 6,000 rad/sec$^2$ might result in a concussion in one instance, but 9,000 rad/sec$^2$ might not result in a concussion in another. It is also not surprising that the CSF would be partially protective against head angular acceleration; otherwise we might all be giving ourselves concussions every time we shake our heads yes or no.

In a concussion the cranium pushes on the surface of the brain at just a few points which then bear the brunt of having to push the entire jello-like brain mass around to try to follow the sudden cranial motion, and so these points experience the most localized strain and shearing and may suffer the previously cited coup and contrecoup injuries. Thus the coup and contrecoup injuries should not be visualized as a one-two punch caused by the brain first crashing against the inside of the cranium at the "front" then rebounding to later crash at the "rear," but rather as a virtually simultaneous, locally stressful and strain-full pushing of the brain around at a few widely separated points where it comes into contact with the cranium. And when a concussion occurs these are not as much physical injuries as they are chemical events wherein the momentary stretching of the walls of the brain cells enables potassium ions to suddenly escape and be replaced by calcium ions, which is a very negative event that may take days or even weeks to correct itself. While being pushed around rotationally, the internal regions of the brain may also get stretched and sheared, which, and as noted above, more than any simple compression is what most agree causes serious brain injury. The most severe form of injury is called Diffuse Axonal Injury, or DAI. DAI damage occurs mostly at the juncture between the outer grey matter and the slightly more dense inner white matter toward the brain's interior, as any angular relative motion between the two could stretch and tear the interconnecting axons over a wide ranging (highly diffuse) area. Some brain experts say that at least some degree of DAI is present with any concussion that involves a loss of consciousness. Strain levels (and high strain rates) of more than 10% are considered to be almost always damaging. Indeed the highest degree of correlation to concussion seems to be the product of brain tissue strain and strain rate, something nearly impossible to measure on football players in situ. But from the standpoint of inventing a more protective helmet (against concussions), it is not necessary to understand all the possible damaging or mitigating factors that exist when translating a high peak angular acceleration level into a high product of strain and strain rate in the exterior and interior regions of the brain.

The liners of most current football helmets already effectively reduce the linear acceleration of the head as compared to the linear acceleration of the helmet shell, which in turn reduces any head angular acceleration contribution that arises through the head-neck pendulum effect. But current helmet liners are not designed to reduce the rotational acceleration of the head that arises from the rotational acceleration of the helmet shell, and this rotational acceleration (from both of the above discussed studies) contributes directly to the total angular acceleration level of the head. Thus, one way to create a better concussion-reducing helmet is to make the helmet liner also reduce any rotational contributor to the total peak angular acceleration of the head which are coming from the rotational acceleration of the helmet shell. Note that for helmet impacts, it is far more likely for a wearer to experience a sudden angular acceleration than an angular deceleration, although the same result would occur either way.

Looking at the shiny, round, hard plastic surface of a football helmet it may be hard to imagine how a helmet shell can even acquire a large rotational acceleration in a helmet-to-helmet collision. After all, it is so smooth and has a rounded, low friction surface. If one holds two empty football helmets by their facemasks, and bangs them together, they just bounce away with little resulting rotation. So one's initial conclusion may be to assume that all of the forces always lie along a line of contact normal to the two surfaces at their contact point, and thus aren't able to cause any rotation. But that is just for the special case where the initial relative motion also lies along the line of contact. If one bangs the helmets together off-center (not along their line of contact), a totally different story emerges—there is a lot of rotation, even without much friction between the two smooth surfaces. The reason is there is still a normal force component that dimples each helmet shell inward (very significantly) at the point of contact. What is amazing is how rapidly the diameter of the dimpled-in area (an effective flat from the standpoint of the other helmet) can increase, and thereby have its effect brought into play. And its effect, in conjunction with any relative tangential velocity, is to cause a suddenly increasing rotation of each helmet shell with accompanying high rotational acceleration levels.

Take the case of two football players running or diving at each other at a closing speed of 25.6 ft/sec (or 7.8 m/sec which is faster than any in the college study, see FIG. 2), and then impacting helmet-to-helmet, not in a centered collision but in a 45 degree off-center collision. Therefore, their effective relative speed in both the helmet normal direction and the helmet tangential direction is about 18 ft/sec (cos 45°=0.707). Assume the helmet shells' normal speeds are shared 50/50 at 9 ft/sec each and each's normal motion is stopped in 5 milliseconds with an assumed approximate quarter sine wave decelerating force. The calculated resulting normal displacement of each helmet shell (equal to the dimpling-in distance) is approximately 0.3 inches, which corresponds to an elastically flattened diameter of 3.2 inches (a little wider than a hockey puck). In this example, the elastic flattening that takes place in 5 milliseconds returns to its original shape in another 5 milliseconds, after which the shells lose contact and separate. Note that in the normal direction both the helmet shells and the players heads are accelerated/decelerated for the full 10 milliseconds that the helmet shells remain in contact. It can be assumed with no loss in generality that the shells came together with equal speeds then decelerated to zero speed in 5 milliseconds, and then in the next 5 milliseconds they were accelerated back up to separation speeds equivalent to their speeds at initial contact but in the opposite directions. Meanwhile, thanks to the liners, the heads may take advantage of the full 10 milliseconds to decelerate to a stop and then the heads (via the neck muscles) can decelerate the shells back to zero speed at lower acceleration levels over a longer time after the shells lose contact with each other. To the heads, that looks like a continued low level acceleration in the same direction as during contact, which is the reason for the long descending plateau region of FIG. 1.

Events occurring within ten milliseconds may be too fast to be seen by the human eye. However, that is not too fast for some of the 18 ft/sec differential tangential velocity in the above non-centric impact example to be picked up by both helmet shells. They'd be tangentially accelerated in the same rotational direction by an oppositely directed friction force exerted on each by the other which is generally proportional to their shared oppositely directed normal force, so the resulting angular acceleration might be expected to have the same sort of waveform as the linear acceleration and be synched to it. If the two shells share that tangential velocity gain equally, then each 9 inch diameter helmet shell could pick up a circumferential velocity of up to 9 ft/sec, which using the same waveform characteristic and same timing would correspond to a maximum peak top-of-the-neck angular acceleration component of up to about 4,000 rad/sec$^2$. That value is right in the ballpark of what might be expected to encompass the actual value for an off-center impact of that intensity, and is consistent with most of the cited football data. The resulting calculated circumferential displacement of the helmet shell is less than half an inch. That establishes the design parameter for what must be accommodated in terms of relative circumferential displacement between the outer shell and the head cap (i.e., by the liner) at not more than an inch.

Note, for those impacts that are near a full 90 degrees off-center (a grazing impact) the relative tangential speed component may be very high, but the normal speed and force components are very low by comparison, so the dimpling-in is small and the time to take-on the tangential speed (via any tangential force) is also small. Also for impacts that are near 0 degrees off-center (a near normal impact) the normal speed and force components may be very high and the dimpled-in time may be also high, but the relative tangential speed is very low by comparison so the tangential speed that can be taken on is limited.

The present invention provides an improved helmet system which contains three essential parts: an inner head cap that is attachable and detachable to the head of a user and moves with the head; an outer impact resistant hard shell which moves independently from the head cap and user's head; and a returnable, energy absorbing liner located in-between the head cap and the outer shell which is compliant both radially and circumferentially in all directions. The returnability feature may be manual for use in sports or other activities where the expected impacts are rare such as bicycling, but automatic for use in sports or other activities, such as football, where the impacts are numerous and repetitive.

The preferred embodiments of the present invention employ an energy absorbing viscoelastic polymeric foam material (PU, EVA, EPP, or the like) to form the liner between the outer shell and the head cap. The liner is configured to be able to reduce linear accelerations and decelerations of the head compared to those of the outer shell as effectively as current prior art helmets. In addition, with the present invention the viscoelastic polymeric foam material of the liner is specially configured to be able to reduce angular accelerations of the head compared to those of the outer shell. To not compromise the latter function, the chin strap with its attached chin protector is fastened to the head cap, which is conformal to and moves with the head, and the chin strap is not fastened or otherwise attached to the outer shell, which has been enabled by the special configuration of the connecting viscoelastic polymeric foam material to be able to move relative to the head cap and the head both linearly and angularly. After an impact, where the outer shell has moved linearly and angularly relative to the head cap and the head, the specially configured liner either causes the outer shell to automatically return to its initial pre-impact start position relative to the head cap and the head, or it enables that return to be manually completed.

In a first preferred embodiment of the present invention, wherein the return is automatic, the special configuration of the viscoelastic foam liner is comprised of a plurality of side-by-side, long and narrow foam columns with their long sides generally radially-oriented so they are slightly tapered (with their wider ends outward). The long narrow foam columns span and nearly fill the space between the outer surface of the head cap and the inner surface of the outer helmet shell, with each column being adhered at each end to each surface. The cross sections of the columns may be triangular, rectangular, pentagonal, hexagonal, round, oval, or other suitable shape, but in all cases should have sufficiently effective length-to-width ratios for the necessary transverse compliance, in addition to the necessary linear compliance, which gives the liner the ability to reduce the angular accelerations of the head.

SUMMARY OF THE INVENTION

Briefly stated, the present invention comprises a protective helmet for repetitive impact applications. Tthe helmet includes a hard impact-resistant outer shell. A head-follower head cap is located within the outer shell. The head cap is a partial surface of similar shape to the outer shell and is adapted to surround at least a portion of the cranial part of a wearer's head. An adjustable chin strap assembly had an attachment/detachment device for securing it to the head cap enabling a wearer to secure and unsecure the helmet to his head. A liner is located between the head cap and outer shell, exhibiting energy absorbing linear compliance and energy absorbing angular compliance. The liner is comprised of a plurality of long, narrow, side-by-side, radially-oriented, elastically compliant foam columns. The columns are well adhered to the outer surface of the head cap and inner surface of the outer shell. The columns efficiently fill much of the available space between the head cap and outer shell forming mating surfaces between the columns such that during a centered impact to the outer shell side-by-side columns in quadrants 90 degrees from the impact undergo S curve bending causing their side surfaces to rub against each other and absorb energy. The bending of those columns is made possible by the compressing of columns in the quadrant near the impact and the stretching of columns in the quadrant opposite the impact. During an off-center impact to the outer shell side-by-side columns in the plane of the impact in all four quadrants undergo S curve bending causing their side surfaces to rub against each other and absorb energy through friction. After an impact the elastic foam columns collectively contribute to the liner automatically returning the outer shell to its pre-impact position with the head cap.

BRIEF DESCRIPTION OF THE SEVERAL VIEWS OF THE DRAWINGS

The foregoing summary, as well as the following detailed analyses of the physical principals and detailed descriptions of the preferred embodiments will be better understood when read in conjunction with the appended drawings. For the purpose of illustrating the invention, particular arrangements and methodologies of preferred embodiments are shown in the drawings. It should be understood, however, that the invention is not limited to the precise arrangements or instrumentalities shown or the methodologies of the detailed description. In the drawings.

DETAILED DESCRIPTION OF THE INVENTION

Figure 5:
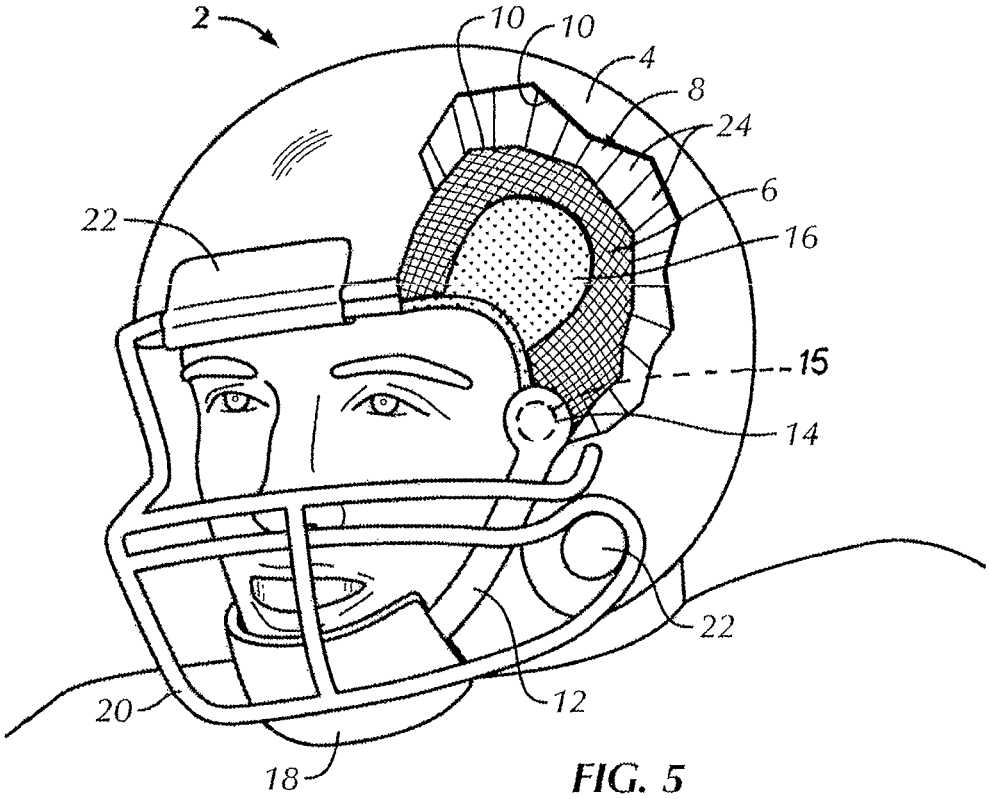
FIG. 5 is a perspective view (selectively cut-away for illustration purposes) of a first preferred embodiment of a football helmet system in accordance with the present invention.

FIG. 5 is a perspective view (selectively cut-away for illustration purposes) of a first preferred embodiment of a helmet system in accordance with the present invention, illustrated as a football helmet assembly or system 2. The preferred embodiment of the football helmet system 2 is comprised of a hard impact-resistant outer shell 4, an inner head-follower head cap 6, a self-returning linear-acceleration-reducing, angular-acceleration-reducing (LAR/AAR) liner layer 8 located between the head cap 6 and the outer shell 4, an adhesion or other securing or attachment material or device 10 to securely affix the LAR/AAR liner 8 to the outside of the head cap 6 and to the inside of the outer shell 4, so the outside surface of the LAR/AAR layer remains fixed with respect to the outer shell 4 and the inner surface of the LAR/AAR liner 8 remains fixed with respect to the head cap 6, an adjustable chin strap assembly 12 having an attachment/detachment device 14 attached to the head cap 6 but not to the outer shell 4 to enable a wearer or user to secure and unsecure the head cap 6 and thereby the entire helmet system 2 to the user's head, a head-follower shell sub-liner 16 to take up any existing space between the user's head and the inside of the head cap 6, a chin protector assembly 18 moveably located along the chin strap assembly 12, and a face guard assembly 20, with an attachment device 22 secured to the outer shell 4.

For football helmets a chin strap assembly 12 is a necessary feature. Its attachment/detachment device 14 may take many forms, including but not limited to, a snap 15, a buckle, a pinch device, and a Velcro® mating surface. For hockey helmets, an under-the-chin or jaw strap (not shown) is typically used. But for some other sports and activities where dislodging impacts are rare, the fit of the head cap 6 itself (with its potential sub liner 16) may be sufficient to hold the helmet 2 in place on the head of the user.

The outer shell 4 is preferably formed of a polycarbonate polymer for its unsurpassed impact resistance, the same material utilized in most modern (prior art) football helmets, though an impact resistant polymer-fiber composite or a generic impact resistant material is acceptable. As with prior art helmets, the shape of the outer shell 4 is a partial spheroid or ellipsoid (sphere-like or ellipse-like, but not necessarily a precisely spherical or elliptical surface), and its diameter and thickness are about the same as current helmets (approximately 9 to 10 inches in diameter and approximately 0.150 inches thick). And to accommodate the effect of its angular displacement on the head, the outer shell 4 may contain regions along its lower rim that are fitted with a soft bumper (not shown) made of elastomer, polymer, elastomeric polymer, or the like.

Likewise, the faceguard assembly 20 may be essentially the same as those utilized with most modern football helmets and it may have essentially the same type attachment device 22 to for securing it to the outer shell 4. The faceguard assembly 20 may be made of steel or aluminum, or a composite of either of these with a polymer covering for a degree of compliance, and attachment may be through a spring or a polymeric or elastomeric grommet for additional compliance. Alternatively, the faceguard assembly 20 may be made of polycarbonate, and potentially molded along with the outer shell 4. With hockey helmets, the face shield is typically a transparent polycarbonate.

The head cap 6 is a partial surface of similar shape to that of the outer shell 4, but obviously smaller in diameter than the outer shell 4, and may have lesser thickness. Also, the head cap 6 need not be impact resistant so almost any polymer, not just polycarbonate, may be used. Other possible materials for the head cap 6 include but are not limited to elastomer, elastomeric polymer, fabric, polymer impregnated fabric, elastomer impregnated fabric, laminated fabric such as Gore-Text, polymer fiber composite, leather, synthetic leather, and even thin metal. Additionally, the head cap 6 is preferably perforated for breathability. Most human heads are not partial spheroids but are generally longer than they are wide, and wider toward the rear than the front. Thus the head cap 6 and outer shell 4 may be partial ellipsoids, or even partial ovoids (egg shaped surfaces), rather than partial spheroids. An ellipsoid in the horizontal plane is the most common helmet shape. Also most human heads are not alike in their shape. Therefore, there will usually be at least a small space between the user's head and the head cap 6. Since the purpose of the head cap 6 is to engage and closely follow the motion of the user's head it is desirable to fill much or all of the space with a sub-liner 16 that is either custom fitted to the particular user, or preferably is conformal to any shape head inside one of a handful of head cap sizes (S, M, L, XL, and XXL), each size pre-mated with a matching outer shell size. To achieve good conformability, a PU (polyurethane) viscoelastic open-cell foam sub-liner material is preferable if the PU foam is of the polyether polyol type (rather than the polyester polyol type) for better moisture resistance. It is also preferable that the foam of the sub-liner 16 be reticulated so that its more open pore structure can provide for greater air circulation. Also, one ore more air bladders (not shown), whether pump-able or not, may be used in the sub-liner 16 to further enhance the customized fit of the head cap 6. It will be appreciated that in some applications no sub-liner 16 is needed.

The LAR/AAR liner 8 has both energy absorbing linear compliance and energy absorbing angular compliance (inner surface vs. outer surface). The first preferred embodiment is comprised of a plurality of long, narrow, side-by-side radially-oriented columns 24, also preferably made of a viscoelastic open-cell foam. The LAR/AAR material may be a PU foam of the polyether type like the conformal sub-liner 16 discussed above, and it too may be reticulated for lower weight and better air circulation. Other suitable materials may be acceptable as well. The slender, tapered columns 24 that preferably make up the LAR/AAR liner 8 (the taper being necessitated by their radial orientation) may be individually molded or cut out and assembled in place, however, it is more preferable for the individual columns 24 to be formed by either molding-in the column-forming grooves, or cutting column-forming grooves in one surface of a molded partial ellipsoid foam annulus that fits between the head cap 6 and the outer shell 4.

Figure 6:
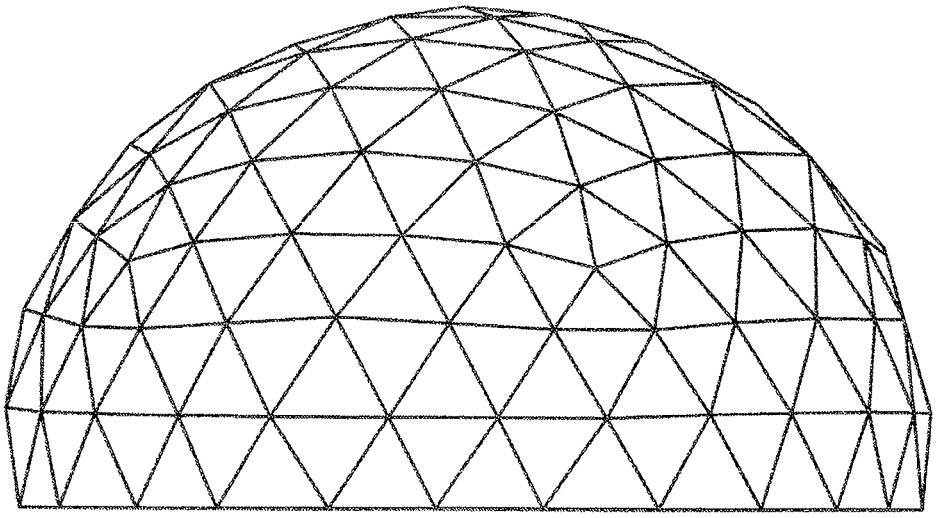
FIG. 6 is a diagram which shows a side view of a 5V 8/15 icosahedron geodesic dome pattern.

To most efficiently fill the available space with similar columns 24, a good groove designing approach is to treat the grooves as if they were the struts of a geodesic dome, where the number of indicated struts would be the number of mating (and hence rubbing) surfaces between the columns 24 and the indicated number of faces would be the number of columns 24. From the published geodesic dome literature (e.g., Geodesic Dome Notes by Rene Mueller, latest update Jan. 15, 2009), scores of possible designs are feasible. One good candidate design is a 5V 8/15 icosahedron dome. FIG. 6 is a side elevational view of a 5V 8/15 geodesic dome pattern. An icosahedron is a twenty sided polyhedron. The 5V means that each triangular side is further subdivided into 25 (or 5 squared) triangles. In the approximately 8/15 the of a full sphere, there are 275 triangular cross section columns (the would-be triangular faces on a true dome) and 425 cut mating flat surfaces (the would-be struts on a true dome). Constructing an actual dome could be problematic with 9 different size struts. But for different size cuts (not struts) there is no problem, especially for a computer controlled cutter. Furthermore, as can be seen in FIG. 6, the cuts are of mostly continuous lines. Also, there ends up being 7 different kinds of triangular cross section columns, but that too is not a problem. In forming a geodesic dome, all of the triangles' intersection points on the polyhedron surface are normalized by projecting them to the surface of a sphere. If the helmet 2 is to be ellipsoid shaped, normalization would project the triangles' intersection points to the surface of the ellipsoid after aligning its center with the otherwise would-be sphere.

The columns 24 have slightly different slenderness ratios, SRs, (7 different SRs in the above case) and thus slightly different bending and compression characteristics, but what is important are their combined bending and compression characteristics, not any minor individual column differences. Though it may seem odd to be talking about slenderness ratios for columns 24 made of foam, not steel, concrete, or wood, it is still a key metric since foam columns 24 that are too wide, with too low a slenderness ratio, might not have the necessary circumferential compliance between the inner head cap 6 and the outer shell 4. Also columns that are too wide would mean fewer surfaces to rub against each other, and thus provide less energy-absorbing friction beyond the foam's own basic viscoelastic characteristic. At the other end of the argument, having columns that are too narrow would mean having too many columns to be practical, and indeed there is likely an identifiable minimum average SR and an identifiable maximum average SR. From just simple "gut feel," the likely minimum average SR seems to be about 3, and the likely maximum average SR seems to be about 30. SR is defined as the effective column length divided by the radius of gyration of the column's cross-section. The theoretical effective length and engineering effective length differ and both vary with the end conditions, but for the purpose of the above indicated ranges, the effective length is taken to be the actual length. The radius of gyration of a triangular cross section is approximately equal to 0.3 times the average width of its sides.

Viscoelastic open-cell foams have been used for many years in prior art football helmets and are well proven to be effective as a compliant energy absorbing material. Reticulated foams are characterized by a complex three dimensional skeletal structure with very few or no membranes between strands. In compression, the strands initially deform elastically, then upon further deformation they begin to buckle (but not all at once), and finally while being bunched all together they begin "densification." When graphically describing the compression characteristic of any given foam, the usual practice is to plot compressive stress vs. compressive strain for the total compression cycle. Typically, the plot slopes upwardly in normal elastic fashion for perhaps 10% of the compression, then it slopes upwardly at a much shallower slope during the buckling phase for about another 50 to 60%, and finally during densification it slopes upwardly again at a steepening angle. The trick is to match the characteristic to the necessary cushioning requirement so that on the one hand it is not too stiff to result in unnecessary force, and on the other it is not too weak as to cause the densification region to come into play with its resulting high force. This is a feasible task that is successfully achieved in most modern helmets, sometimes using more than one type of foam. So no new technology is involved in that aspect. However, with the present invention, the foam columns 24 are not just compressed, they are also stretched opposite the impact point and bent and stretched at places in between. Therefore, high elongation capability (>120%), and high tensile strength (>12 psi) are also requirements for the foam in the present invention. With full densification on the impact side probably maxing out at about 80%, the required stretching or elongation on the other side may be up to 80%. Thus 120% elongation represents a 50% safety factor and a 160% elongation foam, which is well within the capability of a great many available foams, would represent a full 2× safety factor. With an effective area of 50 square inches or more, the 12 psi minimum tensile strength means at least 600 lbs of force would be required to pull the outer shell 4 off of the inner head cap 6, and the chin strap connection 14 would likely open well before that happened. The 12 psi minimum tensile strength requirement is also easily met by many potential candidate foams. The foam would act like a memory foam, with the initial compression and extension taking place within about 15 milliseconds and the full return taking place within a few thousand milliseconds (a few seconds) which would be well before the next play in football, for instance. Since not just compression is involved with the present invention, but extension as well, where there is little buckling of the individual columns 24, the foam liner 8 of the present invention is effectively more resilient, that is it will return to normal faster than if its active elements were all in compression. One commercially available foam that would meet all the above technical requirements is EZ-DRI™ reticulated foam by Crest Foam Industries.

The foam liner elements 24 need to be well adhered at their respective bottom and top surfaces to both the outer surface of the head cap 6 and the inner surface of the outer shell 4, and several adhesives are commercially available that can accomplish that purpose. One such adhesive that may be used is 3M Super 74 Foam Fast Adhesive specially formulated for bonding flexible polyurethane foam to metals and plastics.

Figure 7:
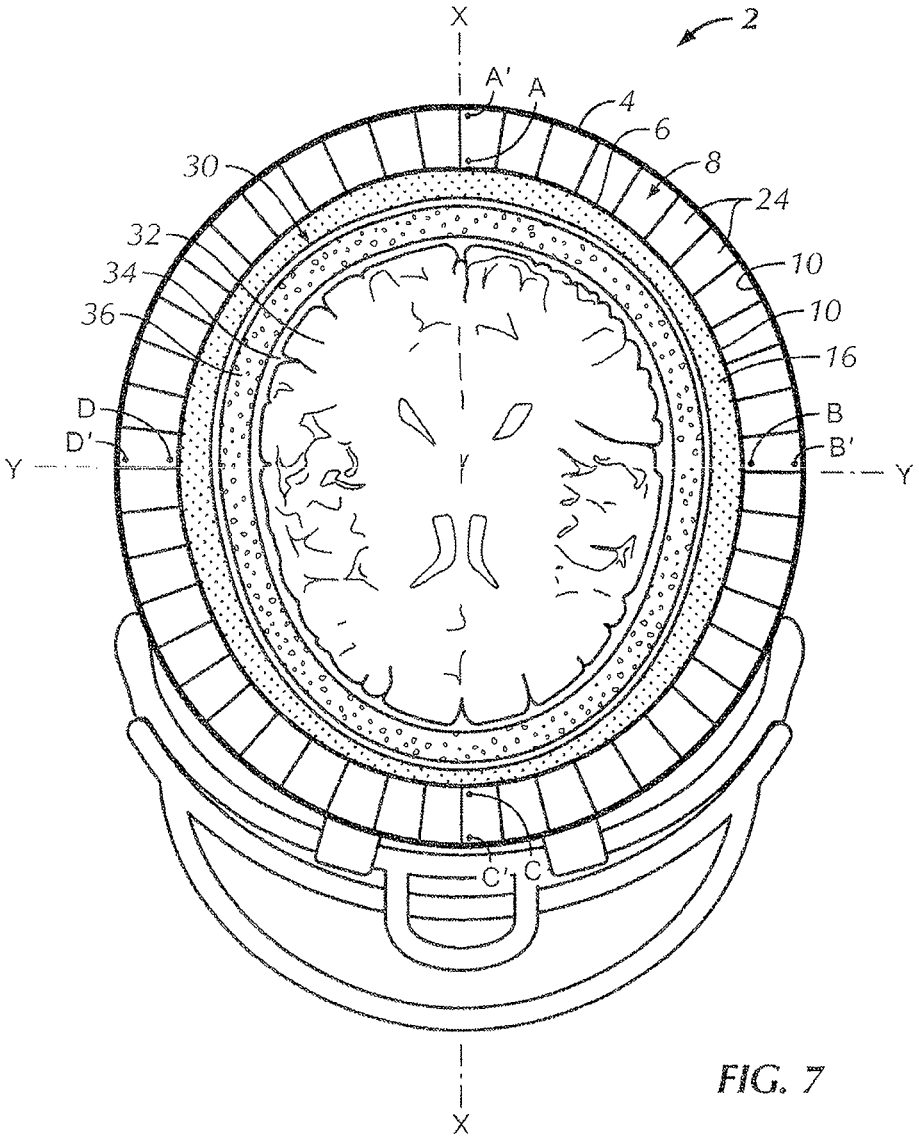
FIG. 7 is a horizontal cross-sectional top plan view of an ellipsoid shaped (long axis front to back) football helmet system in accordance with a preferred embodiment and the user's head and brain (all sectioned approximately 1 inch above the eyes and near the maximum cross sectional circumferences of the inner head cap and the outer shell) illustrating the alignment and position of the components of the helmet system and the essentially radially-oriented foam columns in the pre-impact condition.

FIG. 7 is a horizontal cross-sectional top plan view of an ellipsoid shaped (long axis front to back) football helmet system 2 in accordance with the first preferred embodiment of the present invention and the user's head 30 showing the scalp portion (not numbered), cranium 36, and brain 32 (all sectioned approximately 1 inch above the eyes and near the maximum cross sectional circumferences of the inner head cap 6 and the outer shell 4) to illustrate the alignment and position of the helmet components and the essentially radially-oriented foam columns 24 of the liner 8 in a pre-impact condition. The section is taken near the centers of gravity of both the head 30 and brain 32. There are also two cutout regions (not shown) in the head cap 6 below the cross sectional plane to accommodate the ears and the donning of the helmet 2, thus no foam columns 24 exist in the cutout areas. Notice that first point A on the inner head cap 6 is aligned with corresponding first point A' on the outer shell 4, and second point B is aligned with corresponding second point B', third point C with corresponding third point C', and fourth point D with corresponding fourth point D', and all are initially generally aligned with the inertial axes, XX and YY. Also notice that the brain 32 is aligned with the head 30 and the cerebrospinal fluid 34 exists all around the brain 32. The symmetrical structures near the middle of the brain section are the top portions of the ventricles that supply and replenish the cerebrospinal fluid 34.

Figure 8:
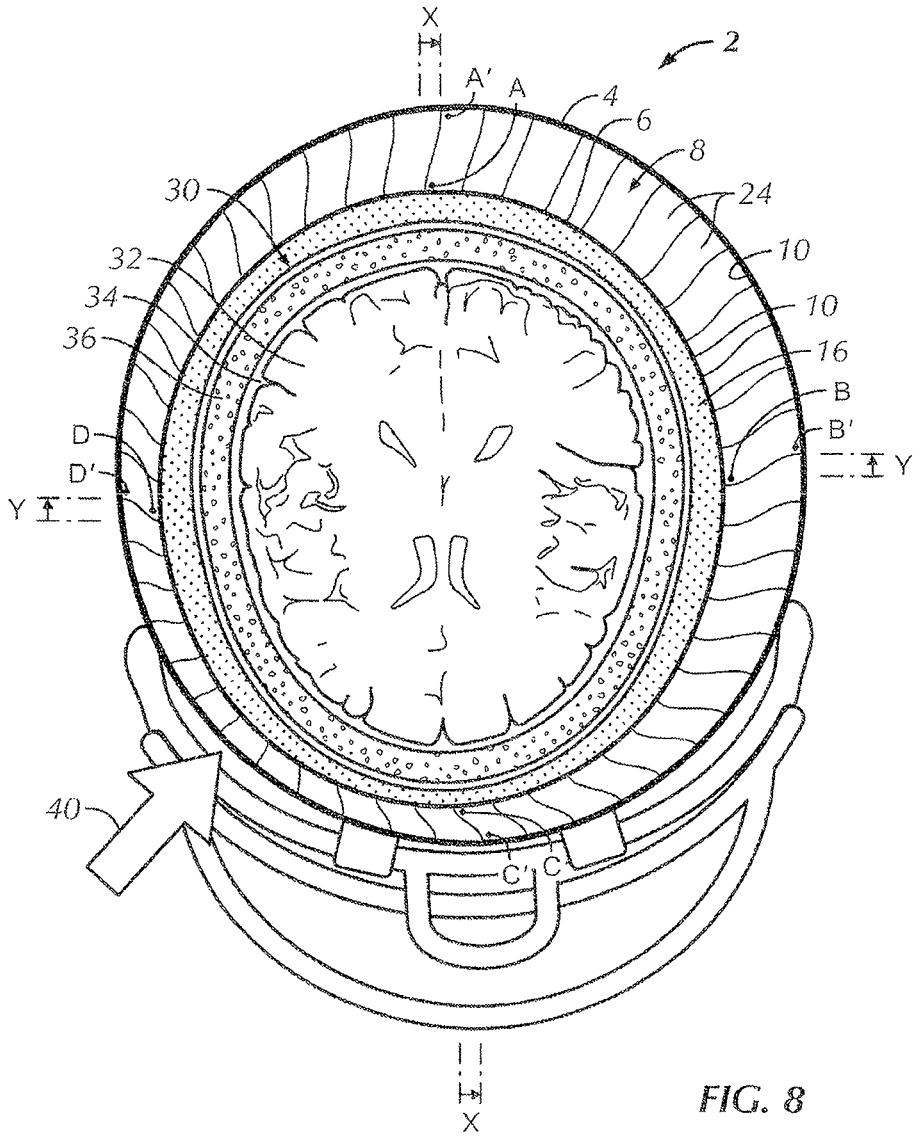
FIG. 8 is the same horizontal cross-sectional top plan view of FIG. 7, about 10 milliseconds after the initiation of a significant centered helmet-to-helmet impact to the right front quadrant of the helmet system, indicated by the large arrow between reference points C' and D.

FIG. 8 is the same horizontal cross-sectional top plan view of FIG. 7, about 10 milliseconds after the initiation of a significant centered helmet-to-helmet impact to the right front quadrant of the helmet 2, indicated by the large arrow 40 between points C' and D'. Note that the impact is in the cross-sectional plane. The term "centered" means the closing velocity is directed toward the center of the helmet 2 and "closing velocity" means the velocity vector of the impacting helmet minus the velocity vector of the impacted helmet just prior to the impact. As a result, notice both the outer shell 4 and the head cap 6 have been moved away from their initial positions (FIG. 7) in their inertial frame, in the direction of the impact, with the outer shell 4 moving about twice as much as the head cap 6, the compliant liner columns 24 symmetrically taking up (absorbing) the difference. The indicated X and Y change is the linear position change of the head 30. The foam columns 24 between points C and D have been mostly compressed, while those between points A and B have been mostly stretched, and those between points B and C, and points D and A, have been mostly deformed into S curves. For the two latter groups especially, all of the stretching convex surfaces have rubbed against all of the adjacent compressing concave surfaces for greater energy absorption. With such a change in the position of the head cap 6 and virtually no change in its orientation, the head position and its orientation remain substantially unchanged relative to the head cap 6 which is held snugly in place on the head 30 by the relatively stiff inner sub-liner 16. Also the brain position and its orientation remain substantially unchanged relative to the head 30 in the horizontal plane since the impact velocity vector is centered through the head, so there is no angular acceleration of the head 30 in the horizontal plane. There is only a linear acceleration of the head 30 in the horizontal plane which has been significantly reduced by the compliance of the liner 8. The already reduced linear acceleration of the head 30 has been further mitigated by the linear accelerating cranium 36 accelerating the trapped cerebrospinal fluid 34, which in turn results in a pressure gradient in the fluid 34 which accelerates the just-slightly higher density brain 32 to nearly keep up with the acceleration of the head 30, as discussed above. There is, however, as a result of the remaining linear acceleration of the head 30 some angular acceleration of the head 30 in the plane that contains the impact velocity vector and the vertical ZZ axis (not shown) through the neck—the so-called head-neck pendulum contributor to angular acceleration—and this angular acceleration slightly tilts the cranium 36 upwardly in the region between points C and D, and downwardly in the region between points A and B. That results in a reduced clearance between the brain 32 and the cranium 36 at the bottom in the region between points C and D, and a reduced clearance between the brain 32 and the cranium 36 at the top in the region between points A and B. Finally, because the impact velocity vector is centered through the head 30, there is no rotational contributor to angular acceleration in this plane either, just the aforementioned head-neck pendulum contributor.

Figure 9:
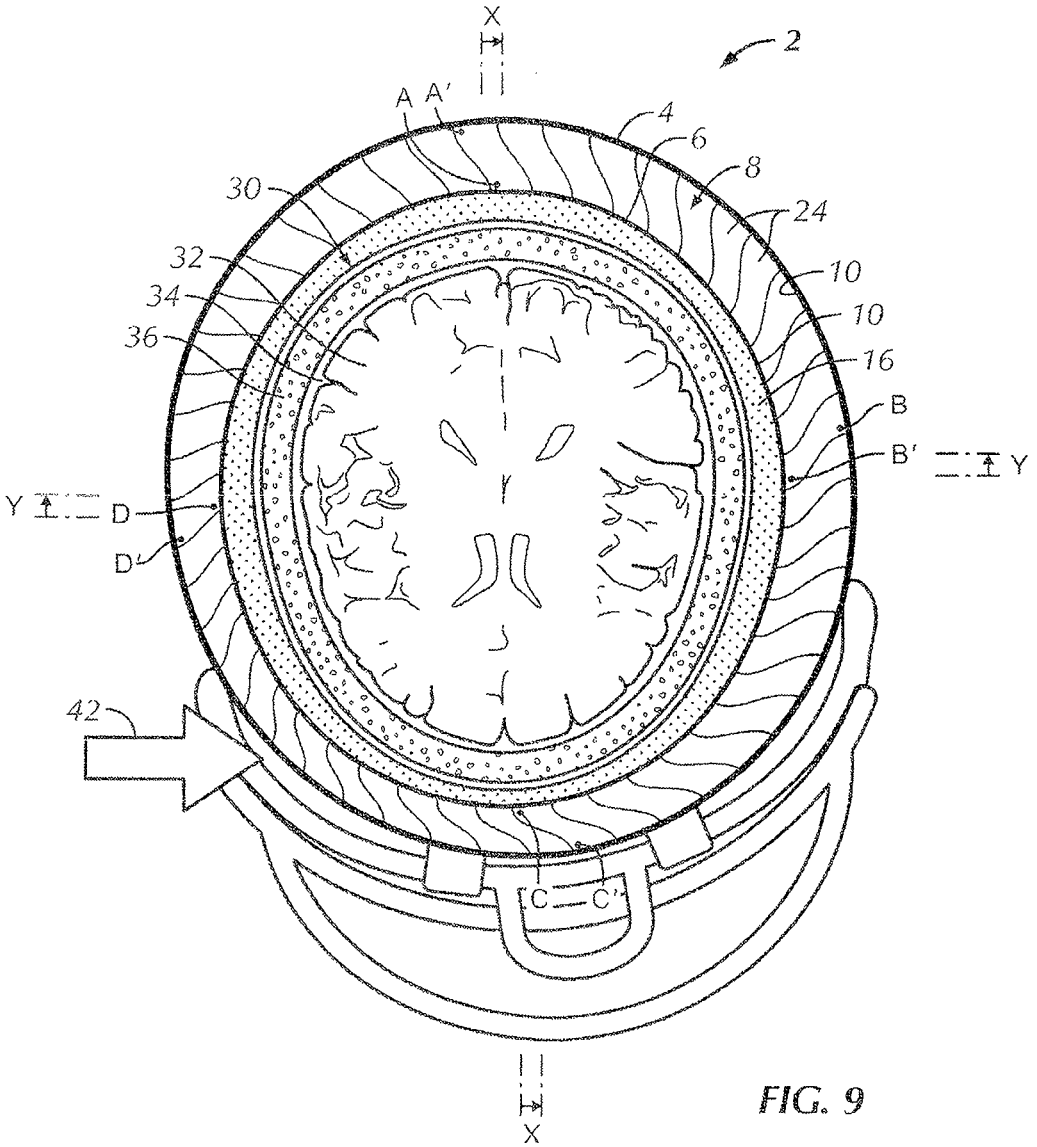
FIG. 9 is the same horizontal cross-sectional top plan view of FIG. 7, about 10 milliseconds after the initiation of a significant off-center helmet-to-helmet impact to the right front quadrant of the helmet, indicated by the large arrow between points C' and D'.

FIG. 9 is the same horizontal cross-sectional top plan view plane of FIG. 7, about 10 milliseconds after the initiation of a significant off-center helmet-to-helmet impact to the right front quadrant of the helmet 2, indicated by the large arrow 42 between points C' and D'. The term "off-center" means the closing velocity is not directed toward the center of the helmet 2, but the impact is still in the cross-sectional plane and "closing velocity" means the velocity vector of the impacting helmet minus the velocity vector of the impacted helmet just prior to the impact. As with FIG. 8, both the outer shell 4 and the head cap 6 have been moved away from their initial positions (FIG. 7) in their inertial frame, still substantially (but a bit less than in the previous case) in the direction from the point of impact toward the center of the helmet 2, with the outer shell 4 again moving about twice as much as the head cap 6, with the liner columns 24 again taking up or absorbing the difference, but this time un-symmetrically. Again the indicated change in X and Y is the linear position change of the head 30. The reason the outer shell 4 has rotated in the horizontal plane is because of the off-center nature of the impact (with the driving frictional force acting via the previously discussed temporarily dimpled-in impacting surfaces), yet the head cap 6 has rotated hardly at all because of the circumferential compliance of the foam liner columns 24. The foam columns 24 between points C and D have been mostly compressed, while those between points A and B have been mostly stretched, and all of the columns 24 have been deformed into S curves. For all of the columns 24, all of the convex surfaces have rubbed against the adjacent concave surfaces for greater energy absorption.

Though the outer shell 4 has moved linearly and also rotated, the multi-columned foam liner's linear compliance has limited the change in the position of the head cap 6 and its circumferential compliance has resulted in almost no change in the orientation of the head cap 6. Thus, everything from the head cap 6 inward remains as it was in the previous case, but with slightly less linear head acceleration and therefore slightly less angular head acceleration from the slightly less pendulum head-neck contributor in the plane containing the ZZ axis (not shown). As with FIG. 8, the head position and its orientation remain substantially unchanged relative to the head cap 6, being held snugly in place by the relatively stiff inner sub-liner 16. The position and orientation of the brain 32 relative to the head 30 in the horizontal plane remain substantially unchanged since there is little direct angular acceleration of the head 30 in the horizontal plane. There is only a linear acceleration of the head 30 in the horizontal plane which has been reduced by the off-center nature of the impact and the linear compliance of the helmet liner 8, and then the already reduced linear acceleration of the head 30, as before, is further mitigated by the linear accelerating cranium 36 accelerating the trapped cerebrospinal fluid 34, which in turn results in a pressure gradient in the fluid 34 which accelerates the just-slightly higher density brain 32 to nearly keep up with the acceleration of the head 30, as discussed above. And as before, there is still, as a result of the remaining linear acceleration of the head 30, some angular acceleration of the head 30 in the plane that contains the impact velocity vector and the vertical ZZ axis (not shown) through the neck—the so-called head-neck pendulum contributor to angular acceleration—and this angular acceleration slightly tilts the cranium upwardly in the region between points C and D, and downwardly in the region between points A and B. That still results in a reduced clearance between the brain 32 and the cranium 36 at the bottom in the region between points C and D, and a reduced clearance between the brain 32 and the cranium 36 at the top in the region between points A and B. Finally, the off-center impact is such that it results in no local, (vertical) rotation at the top of the neck so there is no other rotational contributor to the angular acceleration in this plane, just the aforementioned head-neck pendulum contributor.

Next, it will be useful to compare the above results using the preferred embodiment of the present invention with those that might occur with a prior art helmet.

Figure 10:
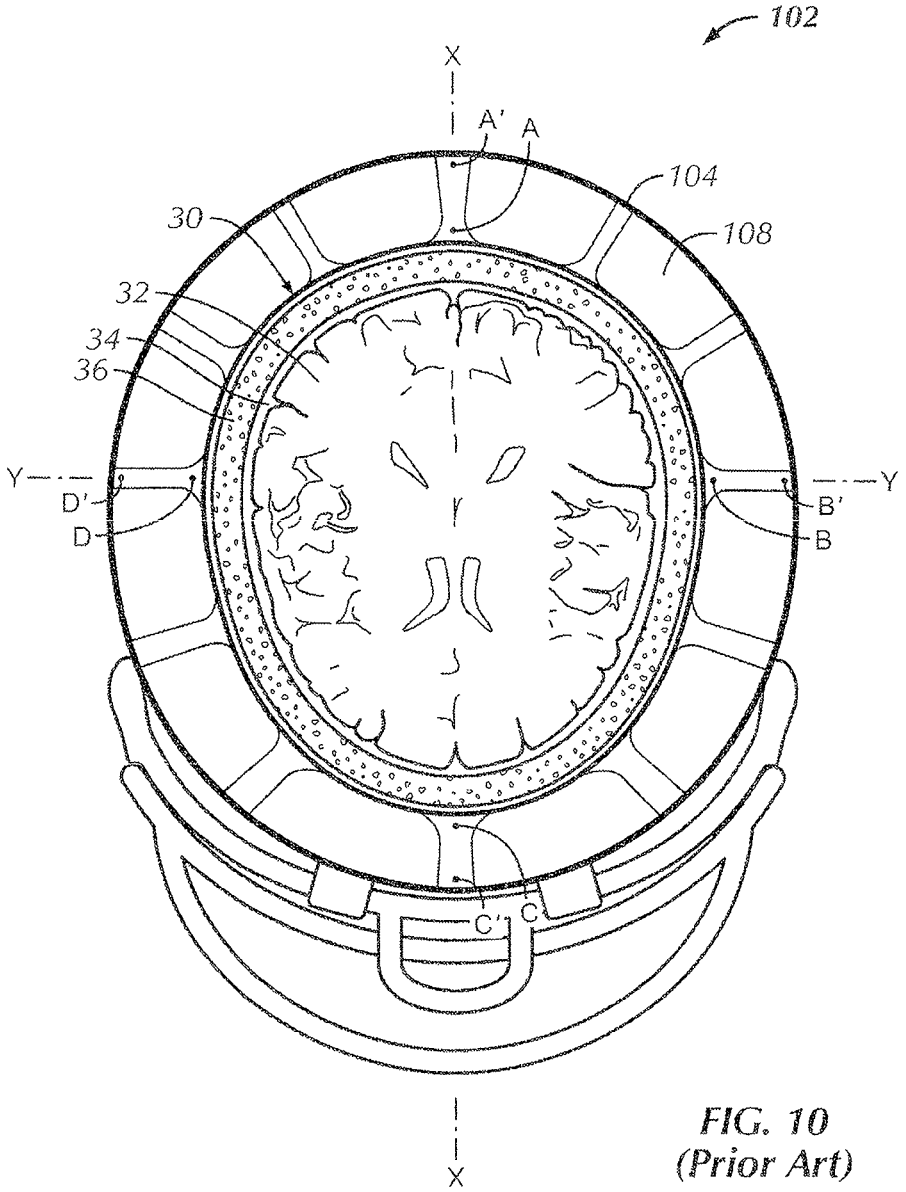
FIG. 10 (Prior Art)
FIG. 10 is a horizontal cross-sectional top plan view of an ellipsoid shaped (long axis front to back) prior art football helmet having an outer shell and compliant liner elements and the user's head and brain (all sectioned approximately 1 inch above the eyes near the maximum cross sectional circumference of the outer shell) to illustrate the alignment and position of these features in the pre-impact condition.

FIG. 10 is a horizontal cross-sectional top plan view of an ellipsoid shaped (long axis front to back) prior art football helmet 102 having an outer shell 104 and a compliant liner 108. Also shown are the user's head 30 and brain 32 (all sectioned approximately 1 inch above the eyes near the maximum cross sectional circumference of the outer shell 104) to illustrate the alignment and position of the helmet components and user features in the pre-impact condition.

Figure 11:
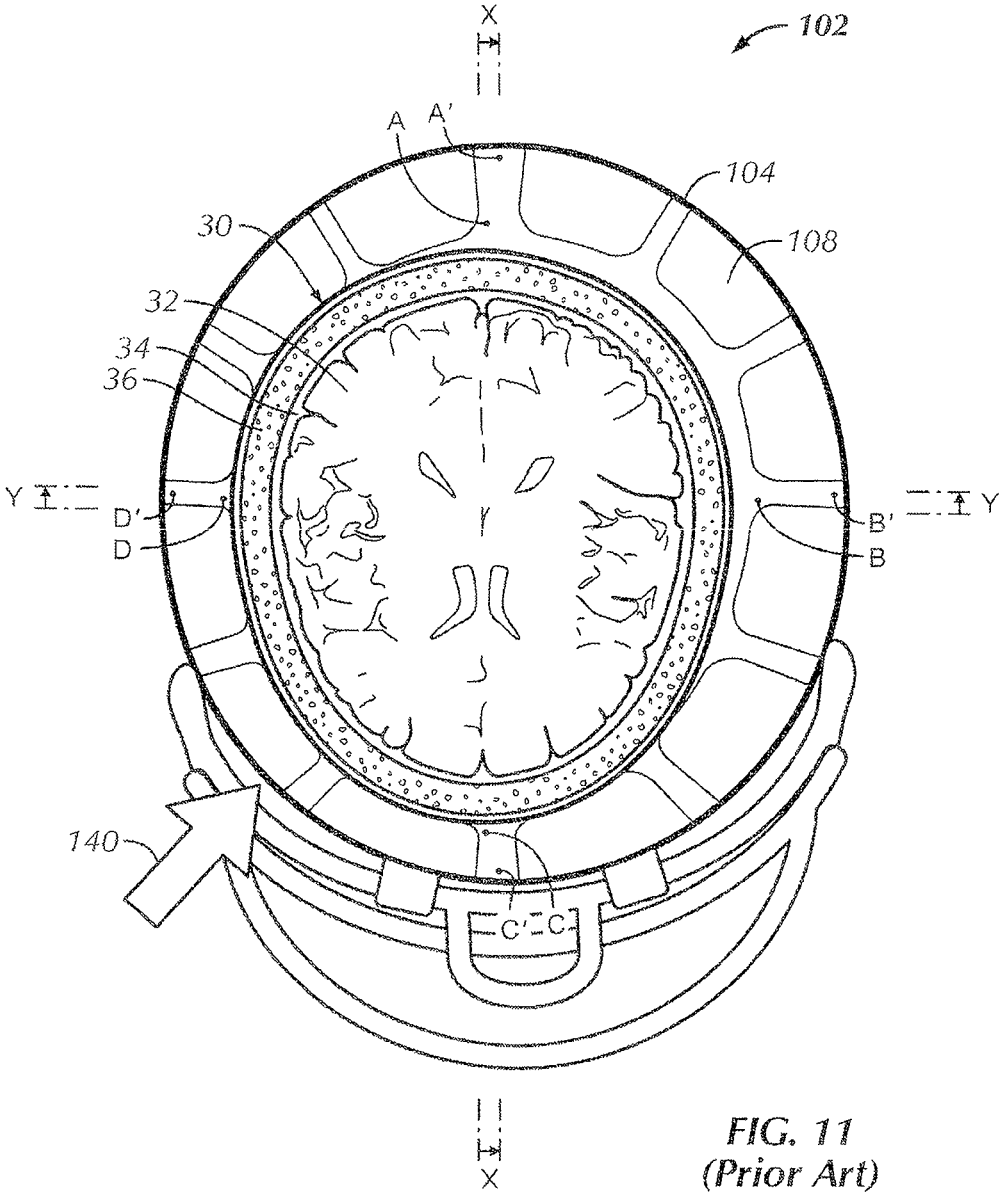
FIG. 11 (Prior Art)
FIG. 11 is the same horizontal cross-sectional top plan view of FIG. 10, about 10 milliseconds after the initiation of a significant centered helmet-to-helmet impact to the right front quadrant of the helmet, indicated by the large arrow between points C' and D'.

FIG. 11 is the same horizontal cross-sectional top plan view of FIG. 10, about 10 milliseconds after the initiation of a significant centered helmet-to-helmet impact to the right front quadrant of the helmet 102, indicated by the large arrow 140 between points C' and D'. As a result, notice that both the outer shell 104 and the head 30 have been moved away from their initial positions in their inertial frame, in the direction of the impact, with the outer shell 104 moving about twice as much as the head 30, the various elements of the liner 108 generally symmetrically taking up or absorbing the difference. Once again, the indicated change in X and Y is the linear position change of the head 30. The elements of the liner 108 between points C and D have been mostly compressed and deformed, while those between points A and B have moved away from the head 30, and those between points B and C, and D and A, are little affected by the impact. Only the elements of the liner 108 in the quadrant around the impact are substantially involved.

As expected, with the centered impact there is just a change in the position of the head 30 and virtually no change in its orientation. Also the brain 32 position and its orientation remain substantially unchanged relative to the head 30 in the horizontal plane since the impact velocity vector is centered through the head 30, so there is no angular acceleration of the head 30 in the horizontal plane. There is only a linear acceleration of the head 30 in the horizontal plane, which has been significantly reduced by the compliance of the elements of the helmet liner 108, and the already reduced linear acceleration of the head 30 has been further mitigated by the linear accelerating cranium 36 accelerating the trapped cerebrospinal fluid 34, which in turn results in a pressure gradient in the fluid 34 which accelerates the only slightly higher density brain 32 to nearly keep up with the acceleration of the head 30, as previously pointed out. There is, however, as a result of the remaining linear acceleration of the head 32 some angular acceleration of the head 32 in the plane that contains the impact velocity vector and the vertical ZZ axis (not shown) through the neck—the so-called head-neck pendulum contributor to angular acceleration—and this angular acceleration slightly tilts the cranium 36 upwardly in the region between points C and D, and downwardly in the region between points A and B. That results in a reduced clearance between the brain and the cranium at the bottom in the region between C and D, and a reduced clearance between the brain 32 and the cranium 36 at the top in the region between points A and B. Finally, because the impact velocity vector is centered through the head 30, there is no rotational contributor to angular acceleration in this plane either, just the aforementioned head-neck pendulum contributor. All of this is very similar to what happens with the present invention in response to a centered impact (FIG. 8). But most helmet-to-helmet impacts are not strictly centered.

Figure 12:
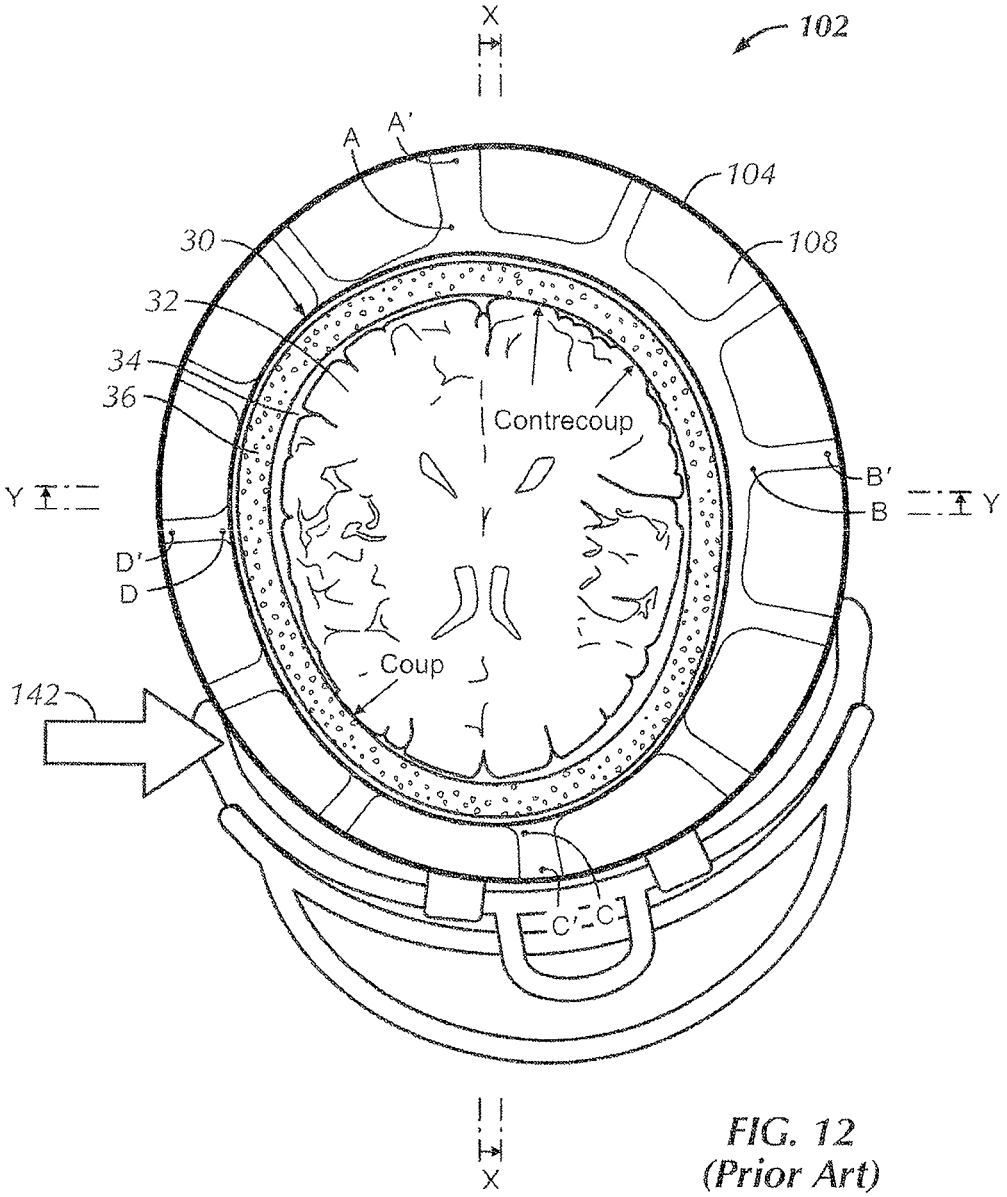
FIG. 12 (Prior Art)
FIG. 12 is the same horizontal cross-sectional top plan view of FIG. 10, about 10 milliseconds after the initiation of a significant off-center helmet-to-helmet impact to the right front quadrant of the helmet, indicated by the large arrow between points C' and D.

FIG. 12 is the same horizontal cross-sectional top plan view of FIG. 10, about 10 milliseconds after the initiation of a significant off-center helmet-to-helmet impact to the right front quadrant of the helmet 102, indicated by the large arrow 142 between points C' and D'. And as with the centered impact (FIG. 11), both the outer shell 104 and the head 30 (see X and Y) have been moved away from their initial positions in their inertial frame, in the direction from the point of impact toward the center of the helmet 102, with the head 30 again moving about half as much as the outer shell 104, with the compliant elements of the liner 108 again taking up or absorbing the difference. But the linear head acceleration and resulting displacement are still reduced compared to the centered case because only the normal component of the impact vector can drive the linear motion.

Just as before, as far as any damaging effect on the brain 32 is concerned, the affect of the reduced linear acceleration is mitigated by the linear accelerating cranium 36 accelerating the trapped cerebrospinal fluid 34, which in turn results in a pressure gradient in the fluid 34 which accelerates the only slightly higher density brain 32 to nearly keep up with the acceleration of the head 30, as previously pointed out. So there is no brain 32 contact with the cranium 36 directly as a result of the reduced linear acceleration of the head.

But there is still, as a result of the reduced linear acceleration of the head 30, some angular acceleration of the head 30 in the vertical plane that contains the normal (inward) impact velocity vector and the ZZ axis (not shown) through the neck—the so-called head-neck pendulum contributor to angular acceleration—and this angular acceleration slightly tilts the cranium 36 upwardly in the region between points C and D, and downwardly in the region between points A and B. And that results in a reduced clearance between the brain 32 and the cranium 36 at the bottom in the region between points C and D, and a reduced clearance between the brain 32 and the cranium 36 at the top in the region between points A and B.

Finally, as can also be seen in FIG. 12, with a prior art helmet 102, there is the potential for a much more serious angular acceleration component in the case of an off-center impact. As with the case of the present invention's response to an off-center impact (FIG. 9), the outer shell 104 has been rotated in the horizontal plane due to the off-center nature of the impact (with the driving frictional force acting via the previously discussed temporarily dimpled-in impacting surfaces). This time, though, the head 30 too has been angularly accelerated horizontally (and rotated) almost as much as the outer shell 104 due to the initial snugness of the helmet liner 108 around the head 30, the tight chin strap connection, and the natural cupping shape of the deforming liner elements, all typical in prior art helmet designs. Note that in FIG. 12 (from point C), the player's nose, although slightly offset to the impact side, is still pointing in the same general direction as the facemask, and so is his head 30. But the cerebrospinal fluid 34 cannot move the brain 32 around as efficiently with an angularly accelerating head 30, as it does with a linearly accelerating head through the pressure gradient mechanism. So rotationally, the brain 32 tends to remain nearly fixed in its inertial plane while the cranium 36 rotates around it. The resulting relative motion can be very damaging. As can be seen clearly in FIG. 12, at the impact location there is a coup contact between the brain 32 and the cranium 36 near the impact point and at one or more places opposite the impact location (two in this case, see the arrows) there are contrecoup contacts—the start of a concussion event—and with any further rotation of the cranium 36, the interior brain tissues may be subjected to high strains and strain rates that could compound the severity of the mild traumatic brain injury MTBI, and even lead to diffuse axonal injury DAI.

Because of the previously discussed head-neck pendulum contributor to the angular acceleration, the actual coup and contrecoup points are likely not exactly located in the horizontal sectioned plane. The resulting reduced clearance between the brain 32 and the cranium 36 at the bottom in the region between points C and D means the coup impact point is likely located below the indicated section plane and the reduced clearance between the brain 32 and the cranium 36 at the top in the region between points A and B means the indicated contrecoup points are likely located above the indicated section plane.

It is clear by comparing FIG. 9 with FIG. 12, that a helmet design that uses the principles of the present invention, which is to employ both linear and angular compliance in the helmet liner design, would likely prevent a concussion while a prior art helmet design would not.

Note that the FIG. 12 off-center impact was located and directed such that it resulted in a horizontal rotational angular acceleration at the top of the neck, and no vertical rotational angular acceleration at the top of the neck. Thus, in a vertical plane, the aforementioned head-neck pendulum contributor is the only contributor to angular acceleration.

In trying to picture the resulting total head angular acceleration, the angular acceleration in the vertical plane (in this case, just from the head-neck pendulum contributor) can be first separated into its pitch and roll components, and then those components can be combined with a yaw component which is the previously discussed head angular acceleration in the horizontal plane.

The combination can be crudely approximated through a "square root of the sum of the squares" procedure for components in orthogonal planes, but this is not a good accurate mathematical process for combining orthogonal angular accelerations (which requires using quarternions or the equivalent for computing accurate total angular acceleration), and it is not the process used in coming up with the HITS waveforms or the peak angular acceleration values in the two cited studies. Nevertheless, it provides a "feel" for how the gross magnitudes might sum. Three example cases will now illustrate this. In these examples, the terms horizontal and vertical mean "relative to the head." Case 1, for an angular acceleration in the vertical plane that is half of what it is in the horizontal plane, the total angular acceleration would be only increased approximately 12% over what it is in the horizontal plane. Case 2, for an angular acceleration in the vertical plane that is equal to the angular acceleration in the horizontal plane, the total angular acceleration would be increased approximately 41% over what it is in the horizontal plane. Case 3, for an angular acceleration in a vertical plane that is combined with a second angular acceleration in the same vertical plane, then they either directly add, or directly subtract, depending on whether they are in the same direction, or in opposite directions. For two equal additive angular accelerations, it would double. Note that the actual impact itself need not be vertically directed, and most likely would not be vertically directed.

A Case 3 situation occurs whenever an off-center (non-normal) surface impact is in a centered vertical plane—one that goes through the center of the head. Though in a vertical plane, the impact itself could be horizontal, or could come from some other elevation above or below the horizontal. The centered vertical plane could be the midsagittal plane (through the nose), the coronal plane (through the ears), or any other centered vertical plane in between. From the previously noted reduced affect on the head-neck rotational head angular acceleration contributor of "glancing" and "near-normal" surface impacts, the Case 3 helmet-to-helmet impact that is most likely to result in a large total head angular acceleration would be one that is oriented approximately 45° from the impact surface (such an impact would be about 3½ inches off-center, measured as the shortest perpendicular distance from the extended impact vector to the center of the helmet or head). The top-of-the-neck rotational head angular acceleration contributor arises from the surface tangential component of the impact vector. It can be substantial with prior art helmets, yet may be near zero with a present invention helmet 2 due to the large circumferential compliance of its liner 8. The head-neck pendulum head angular acceleration contributor arises from the horizontal component of the surface normal component of the impact vector. As such, for a 45° surface impact, one at the vertical midpoint of the head 30 (and helmet 2) results in the maximum horizontal component of the surface normal component for maximum head-neck pendulum head angular acceleration. Furthermore, if the impact is directed 45° upward, rather than 45° downward, it will be additive (not subtractive) with the top-of-the-neck rotational head angular acceleration for maximum total head angular acceleration. A hit like this would correspond to a quarterback being hit upward from behind on the back of his helmet by the helmet of a defensive lineman, which is not uncommon and is possibly one reason why quarterbacks suffer so many concussions. With the present invention helmet 2, there would be little or no top-of-the-neck rotational head angular acceleration for a much lower total head angular acceleration, and thus much less chance of a concussion.

An upwardly directed facemask impact is another potentially serious additive Case 3 impact. One example was the well publicized, upward tangential impact to DeSean Jackson's facemask in the Eagles-Falcons game on Oct. 18, 2010, from which Jackson suffered a severe concussion with several minutes of unconsciousness and memory loss. With a present invention helmet 2, however, even for a facemask impact, the top-of-the-neck rotational head angular acceleration contributor would be reduced to near zero due to the large circumferential compliance between the outer shell 4 and the head cap 6. The helmet 2 (specifically the outer shell and portions of the liner 8) would still be rotated but the head cap 6 (and head 30) would not be rotated, or at the least, would be rotated by a much smaller amount.

In the first preferred embodiment of the present invention's football helmet design, that circumferential compliance comes about in large part because of the significantly reduced lateral stiffness of the individual foam columns 24 of the liner 8. With most current helmet designs, for example the latest Revolution helmet by Riddell, the individual foam elements are wide blocks rather than narrow columns, and therefore, even though they are still made of foam, they cannot manifest the same degree of lateral compliance. To determine the elastic lateral compliance of a column 24, or a block, it may be modeled as a vertical beam which is side-loaded at the top. Its compliance (or displacement per unit force) is then proportional to the cube of its height (h); and inversely proportional to its elastic modulus (E), its effective width (b), and the cube of its effective depth (d) in the force direction. If one then bisects the block vertically in two directions, thereby cutting it into four equal columns, the new lateral compliance of each column becomes 16 times that of the original block, and so the total lateral compliance of the four columns together becomes 4 times that of the original block. If alternatively, one were to trisect the original block vertically in two directions thereby cutting it into nine equal columns, the new lateral compliance of each column would be 81 times that of the original block and so the total lateral compliance of the nine columns together becomes 9 times that of the original block. Thus, as a general rule, the column lateral compliance of the present invention compared to the old block lateral compliance is approximately equal to the number of columns 24 divided by the number of old blocks in the same given area. Going back to the 275 columns of the 5V 8/15 icosahedron geodesic dome pattern and comparing the resulting 275 columns with the approximately 20 blocks inside a prior art Revolution helmet, the lateral compliance of the preferred embodiment of the present invention would be about 15 times greater for the same stiffness foam material. And still other possible geodesic dome patterns yield 400 or more columns—for example a 7V 11/22 icosahedron geodesic dome pattern yields 525 columns. However, as shown in FIG. 8 and FIG. 11, all of the column elements in the present invention participate in the linear stiffness of the LAR/AAR liner 8 in some manner, whereas in the Revolution helmet only about ¼ of the foam blocks (those directly around the impact) are involved in the linear (compressive) stiffness. Thus, for the same linear (normal direction) compliance, the PU foam in the present invention could be far less stiff (perhaps by a factor of one-quarter) than the foam in the prior art Revolution helmet, and so the lateral (circumferential direction) compliance of the LAR/AAR liner 8 in the present invention could be of the order of up to 60 times greater (not just 15 times greater) than the lateral (circumferential) compliance of the prior art Revolution helmet (and even greater if divided into more columns as indicted above). That is very significant and very important for being able to nearly eliminate the top-of-the-neck head angular acceleration contributor. Actually, the foam blocks used in the prior art Revolution helmet are a sandwich of two different foams having different stiffness, but the same reasoning still applies.

The prior art Riddell Revolution helmet, and its successors the prior art Revolution Speed and later Riddell 360 incorporate a significant linear (normal) compliance in the liner to protect against high linear acceleration of the head, but everything else, by purposeful design, is to keep a player's head snugly in-place angularly relative to the helmet shell by incorporating features that preclude lateral (circumferential) compliance in the liner. This includes inflatable bladders in the sides and back of the liner for a snugger "customized" fit. Other competitive prior art helmets on the market, also by design, preclude circumferential compliance between the helmet shell and the head, thereby imparting unabated, most, if not all, of any top-of-the-neck, helmet shell rotational angular acceleration to the head, which adds, often directly, to the head-neck pendulum motion that arises from the horizontal portion of a surface normal component at the impact point.

The second leading football helmet manufacturer, after Riddell, is Schutt Sports. The Schutt ION 4D and DNA Pro+ models utilize Thermoplastic Urethane TPU liners made by SKYDEX. TPU is a polymer but it can act and feel like an elastomer. The molded-in individual dual elements of the liner collapse within each other axially in the helmet radial direction (a process they call Twin Hemisphere Technology) to provide the desired linear compliance and a fair degree of impact absorption. However, the radial nesting process precludes any circumferential motion between the individual dual TPU elements, and thus the liner provides virtually no lateral (circumferential) compliance between the helmet shell and the head.

A third, and newer company, Xenith, also makes football helmets. Their helmet, the X1, uses for its liner, about eighteen individual hollow air-filled puck-shaped elastomer cylinders each with a valve that slowly lets the air out to linearly cushion a player's head when the cylinders are compressed in a helmet collision. That provides the desired linear (radial) compliance between the helmet and the head. But like the Riddell and Schutt helmets above, the squat, puck-like cylinders provide little or no lateral (circumferential) compliance for the Xenith X1 helmet.

Moreover, the fitting instructions for all of the above prior art helmets stress snug fit and proper tightening of the chin strap, so that when the user's head is held firmly still, the user cannot jiggle the helmet shell around it. Clearly, "snug fit and proper tightening of the chin strap" sounds like a correct procedure—and for any football helmet it should be. But only with the present invention, "snug fit, and proper tightening of the chin strap" applies to the head-following head cap 6 and not the helmet shell 4. Then when a user holds his head firmly still and tries to jiggle the helmet shell 4, the helmet shell 4 jiggles, but the head cap 6 remains firmly unmoved, along with the head 30. That is the quick test for large circumferential compliance, and the test for reduced chance of concussion.

Summarized herein are the main points for why the present invention is needed; why, as shown by new insights presented herein, prior art helmets aren't as concussion resistant as one might hope; and how the present invention incorporates those new insights in a novel and practical way to make a more concussion resistant helmet.

There are an estimated 300,000 football concussions a year—which is an annual incidence rate of about 6% of the estimated nearly 5 million players at all levels. Helmets have been substantially improved, yet the percentage of concussions has not been substantially lowered (though some of the new helmet models claim to show limited reductions). The number of the concussions reported by the NFL for the 2011 season exceeded 10% of the number of players. The helmet improvements have largely been to reduce the linear acceleration levels experienced by a player's head in an impact. However, the helmet improvements have not correspondingly reduced the angular acceleration levels experienced by a player's head in an impact.

The cerebrospinal fluid (CSF) 34 that surrounds the brain 32 is not merely a liquid cushion against the brain crashing into the cranium 36 in response to a (high G) linear acceleration (or deceleration) of the head. The CSF's own corresponding acceleration (or deceleration) creates a pressure gradient within the CSF that simultaneously accelerates (or decelerates) the brain 32 at approximately the same rate, thereby keeping the brain from crashing into the cranium. Thus the main concussion causer in a helmet-to-helmet impact must be high angular acceleration of the head 30, where the CSF is a less effective mitigator.

Two contributors to high angular acceleration of the head are identified. Ironically, because of the existence of a head-neck pendulum motion, the first contributor is high linear acceleration of the head in the horizontal direction. As a result, high linear acceleration of the head still needs to be reduced by high linear compliance of the helmet liner 8, especially in the head horizontal direction. The second contributor to high angular acceleration of the head is a rotational angular acceleration at the top of the neck caused by an off-center helmet impact. This confirms that not just the location of an impact is important, but the direction of the impact is also important. The data show that the magnitudes of two contributors to total head angular acceleration may be generally in the same ballpark. Thus, when the two contributors to the total head angular acceleration are in the same centered vertical plane, the second contributor could directly add to the first contributor for twice the impact. The second contributor to the total angular acceleration of the head can be reduced by adding concurrent circumferential compliance to the helmet liner. Significant circumferential compliance can be incorporated into a foam helmet liner 8, without altering its already high linear compliance, by segmenting the liner into a plurality of narrow, radially-oriented foam columns 24 for vastly improved lateral compliance of the columns and resulting circumferential compliance of the liner. The chin strap, if still connected to the outer shell 4, could compromise the newly gained circumferential compliance by forcing the head to follow the outer shell motion, and so the chin strap is transferred to the inner head cap 6 which follows only the head motion. The head-follower head cap 6 moves with the head 30, and a combined linearly and angularly compliant, linear acceleration reducing, angular acceleration reducing (LAR/AAR) liner 8 lets the outer shell 4 move both radially and circumferentially relative to the head 30.

Figure 1:
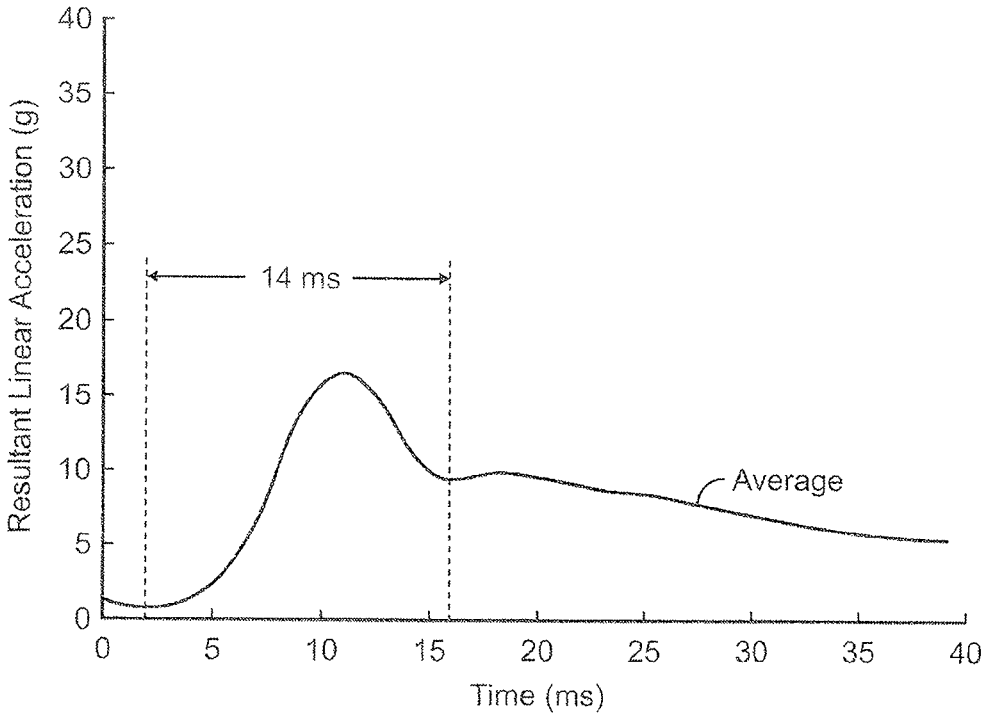
FIG. 1 is a diagram which shows an average linear head acceleration response for a telemetry based in-situ head impact of a college football study.
Figure 2:
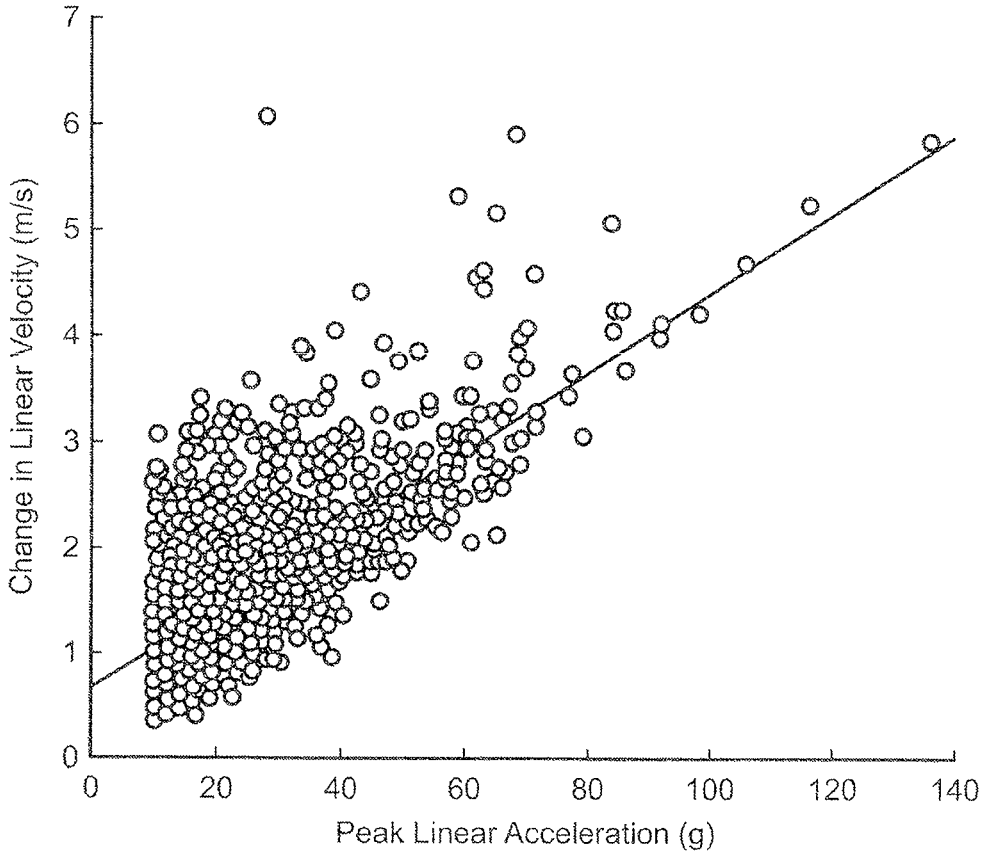
FIG. 2 is a diagram which shows, for the same study, a scatter plot of the change in linear velocity of the head vs. peak linear acceleration for all of the inputs.
Figure 3:
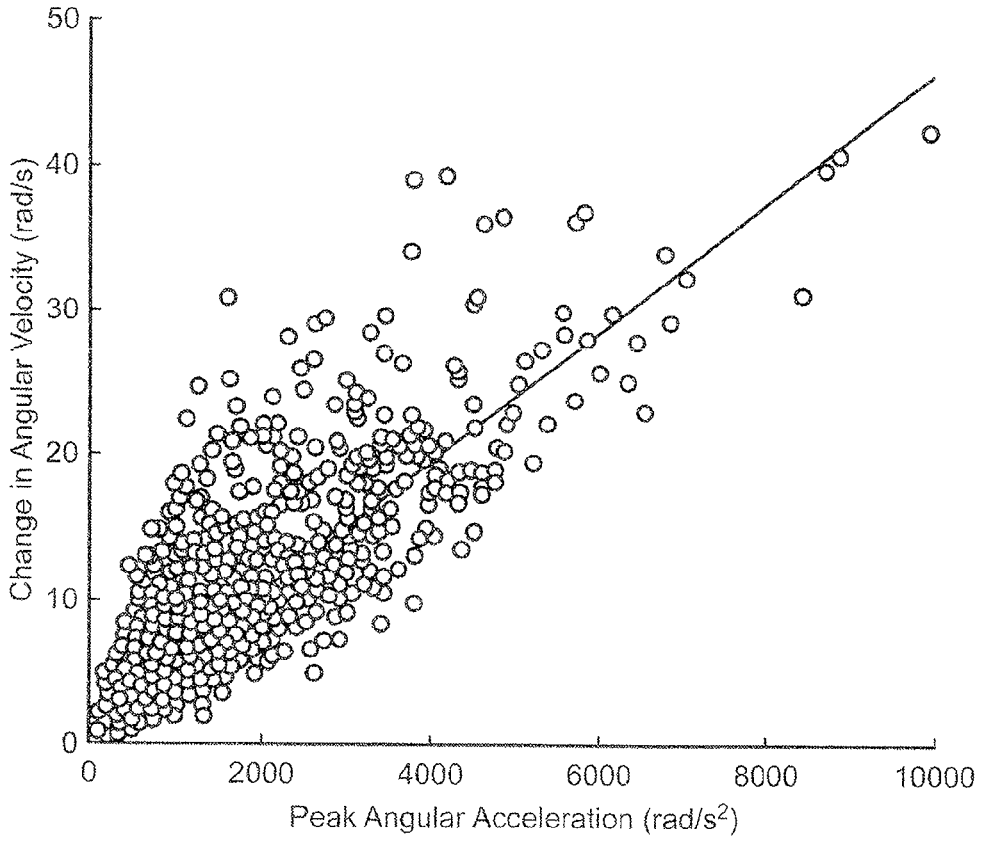
FIG. 3 is a diagram which shows, for the same study, a scatter plot of peak angular acceleration vs. peak angular acceleration for all of the impacts.
Figure 4:
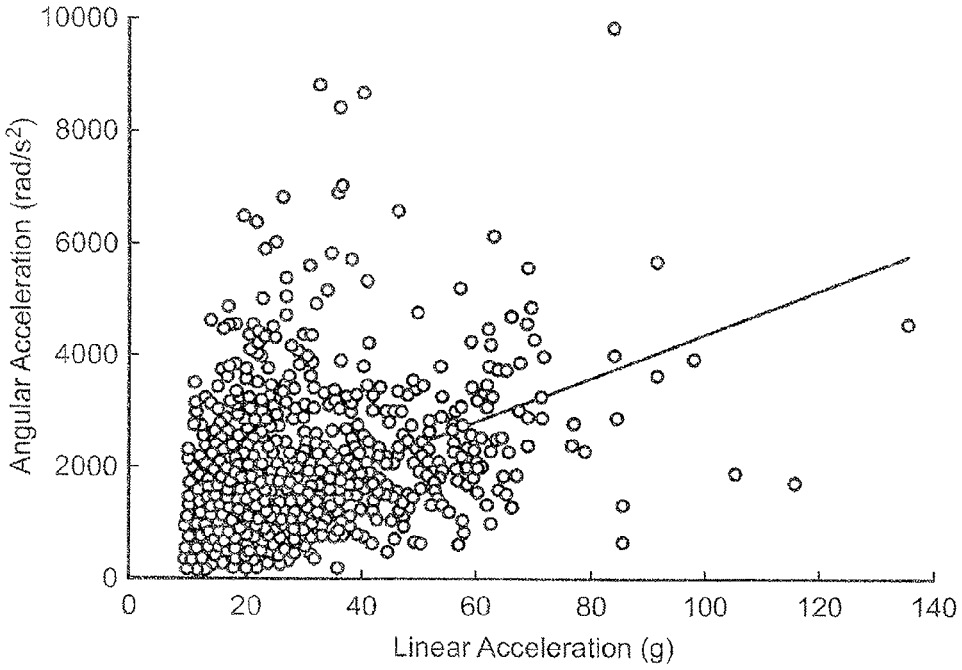
FIG. 4 is a diagram which shows, for the same study, a scatter plot of the peak angular acceleration vs. peak linear acceleration for all of the impacts.
Figure 13:
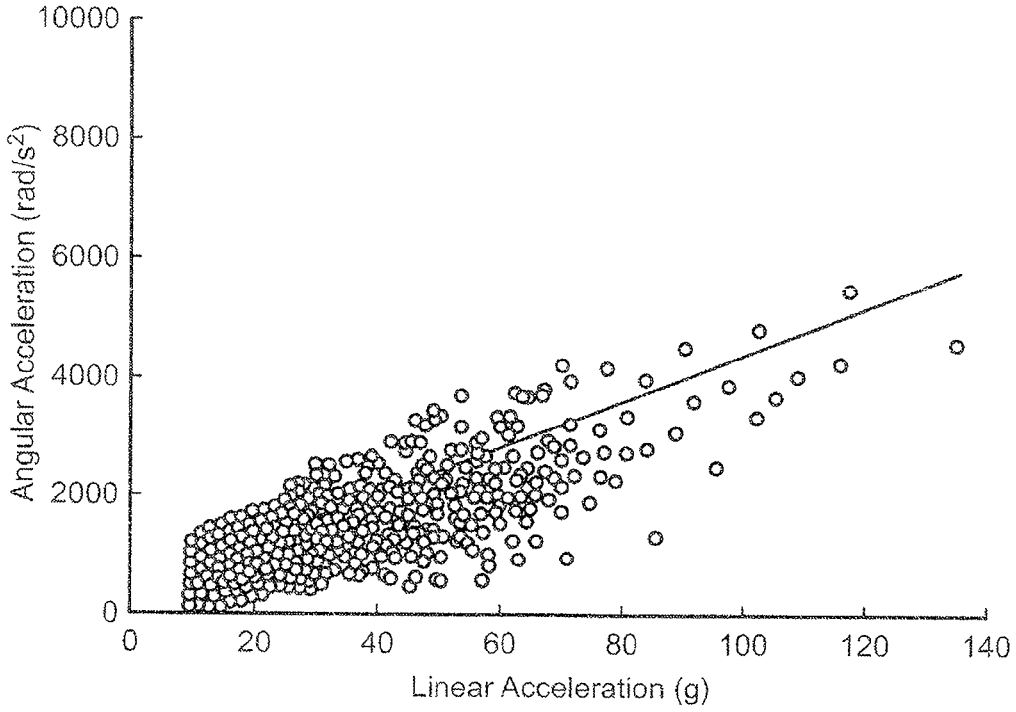
FIG. 13 is a diagram which shows a hypothetical version of the previously discussed FIG. 4 diagram (from the college study) of angular acceleration vs. linear acceleration assuming that the Riddell Revolution helmet in the college study has been replaced by the first preferred embodiment of the helmet system of the present invention.

FIG. 13 is a diagram which shows a hypothetical version of the previously discussed FIG. 4 diagram (from the college study) of angular acceleration vs. linear acceleration. In FIG. 13, it is assumed that the prior art Revolution helmet has been replaced by the first preferred embodiment helmet 2 of the present invention. Comparing FIG. 13 with FIG. 4, the effect of using the present invention helmet 2 is dramatic. Note that the 4,300 rad/sec$^2$ per 100 G reference line in FIG. 4 has been included in FIG. 13. to aid the comparison. With the helmet shell 4 now being able to rotate easily relative to the head 30, the second contributor to head angular acceleration (the top-of-the-neck head rotational acceleration) is substantially eliminated, and only the head-neck pendulum contributor still comes through. Using an assumed pendulum distance of 8 inches, its contribution could be as high as 4,830 rad/sec$^2$ per 100 Gs for a straight horizontal impact at mid helmet height, but for the majority of impacts, which would be about 45° from the surface normal, that relationship would reduce to about 3,400 rad/sec$^2$ per 100 Gs at mid helmet height, reduce down to about 2,400 rad/sec$^2$ per 100 Gs on average for a 45° impact elsewhere on the helmet 2, and finally reduce all the way down to 0 rad/sec$^2$ for a straight vertical impact to the very top of the helmet 2.

It would certainly still be possible to get into the concussion range of >5,500 rad/sec$^2$, but that would likely require a straight mid helmet height hit of nearly 120 Gs, and even greater if not a straight mid helmet hit. The above numbers clearly demonstrate that the widespread use of the present invention helmet 2—where the radial compliance of the liner 8 is maintained and circumferential compliance is added to significantly reduce the top-of-the-neck rotational contributor to head angular acceleration—could conceivably reduce the incidence of football concussions by a potentially very large amount.

That should not be surprising since up to now, the various helmet liner improvements have addressed only linear head acceleration levels, which affect just the head-neck pendulum contributor to total head angular acceleration. Also, the improvements have been just incremental in scope, so the improvements in outcomes have been incremental as well. But now, by making the liner address the certainly equally significant top-of-the-neck rotational head angular acceleration contributor for the first time while maintaining the improvements in reduced linear head acceleration, a breakthrough improvement in outcome is possible.

However, FIG. 4 and FIG. 13 also show that the reduction of the top-of-the-neck rotational head angular acceleration contributor can be a double edged sword. The reductions in head angular acceleration at the high end can be large and significant, but so can some increases at the low end be large but they are not significant. In football, with current prior art helmets, helmet-to-helmet collisions that cause the top-of-the-neck contributor to add to the head-neck pendulum contributor for one colliding player may cause it to subtract for the other. With present invention helmets, that subtraction would be less. Yet that appears to be a very acceptable situation for football. The situation and logic are best illustrated by an example.

Figure 14:
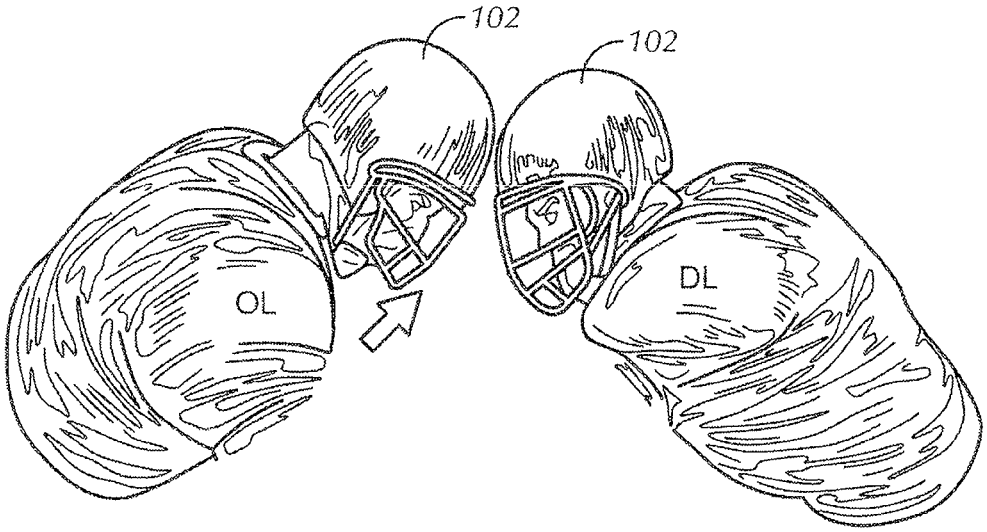
FIG. 14 (Prior Art)
FIG. 14 is an elevational view which shows two football players, an offensive lineman and a defensive lineman who are about to collide helmet-to-helmet due to the offensive lineman lunging upwardly toward the defensive lineman, both players wearing prior art helmets.

See FIG. 14—a current prior-art football helmet 102 example: An offensive lineman (OL) and a defensive lineman (DL) collide helmet-to-helmet. For each player, the point of impact is at the front of his helmet in the midsagittal plane just above his face guard. The OL gets lower than the DL and the impact occurs when the OL lunges forwardly and upwardly (as shown by the unlabeled arrow) at the DL (in their joint midsagittal plane) which is also the plane of FIG. 14, where the OL is shown on the left and the DL on the right. From this viewpoint, the head horizontal components of the normal force angularly accelerate the DL's head clockwise (CW) and the OL's head counterclockwise (CCW) about the base of their necks (the head neck pendulum contributor). However, during the approximate 10 millisecond period of the impact while the two helmets very locally deform inwardly and then outwardly again, the OL's helmet continues to push upwardly and to the right, thereby exerting a surface tangential friction force on the DL's helmet which angularly accelerates the DL's helmet and head CW about the top of his neck (the top-of-the-neck contributor), and this adds directly to the CW angular acceleration from the head-neck pendulum contributor, thus the DL sees an increased angular acceleration as a result of the top-of-the-neck contributor. While all that is going on, the equal and opposite tangential friction force on the OL's helmet likewise angularly accelerates the OL's helmet and head CW about the top of his neck which subtracts directly from the CCW angular acceleration from the head neck-pendulum contributor and so the OL sees a decreased angular acceleration as a result of the top-of-the-neck contributor. Thus, in this example, with current helmets the striking player (the OL) is much less likely to suffer a concussion than the struck player (the DL).

This outcome which favored the striking player (in this case the OL) had nothing to do with who was moving and who was not. That's because from a physics standpoint, the inertial plane of either player could've been considered stationary. Instead, the outcome was solely the result of the impact location and the direction of impact and how they related to the location of the player's neck (and body).

In the example, the impact location and how it related to the player's neck and body was exactly the same for both players. And the impact occurred in the midsagittal plane for both players. Yet the outcome for the two players was very different. That difference arose from the direction of the impact. The direction of impact can be thought of as the direction from which a flea sitting on the one player's helmet at the impact point would see another flea coming who is sitting on the other player's helmet at the impact point just before the two fleas get crushed out of existence. For the DL, the direction of impact was from the lower left, directed roughly at a right angle to his neck and body, while for the OL the direction of impact was from the upper right and directed downward toward his body.

In a helmet-to-helmet collision, the striking player (the one leading with his helmet), in most cases will see the impact generally directed inwardly toward his body, thus for an off-center impact above the c.g. plane of the head the resulting tangential force typically gives rise to a top-of-the-neck rotational contributor which opposes the head-neck pendulum angular acceleration contributor from the normal force. With current helmets which transmit virtually all the resulting top-of-the-neck rotational acceleration unabated to the head, that top-of-the-neck contributor would then subtract from any head-neck pendulum contributor to provide the striking player a reduced concussion probability as an undeserved reward. So with current helmets, players who inflict helmet hits on other players often walk away unscathed.

But the present invention could alter that picture. It substantially reduces the top-of-the-neck contributor, thereby not only reducing the probability of a concussion in any given helmet-to-helmet collision, but also reducing the present unfair skewing of the probability of a concussion (which with current helmets tends to protect the player who leads with his helmet), so based on the loss of that unfair protection the new helmet concept would no longer encourage the practice of leading with one's helmet.

That should alleviate any risk compensation concerns a behavioral psychologist might have with a concussion reducing helmet—a concern that players might then feel so safe they would tackle helmet first. But in this case, just the opposite would be true. A player would actually be less safe tackling helmet first, and that fact could be pointed out to all players warning them not to get reckless with their new safer helmets. Still they would likely walk away unconcussed from most self-initiated helmet-first tackles, just not as often as before. In the cited example, if the OL and DL were wearing present invention helmets, the OL would be more likely to be concussed than before, but he'd still be less likely to be concussed than the DL who would now be much less likely to be concussed than before.

Thus the present invention might offer the best of both worlds for football—for a given helmet-to-helmet hit it would lower the probability of anyone sustaining a concussion, plus it would provide an inherent behavioral modification incentive for those perennial helmet-first tacklers to alter their ways. Taken together, that might substantially reduce the unacceptable number of football concussions.

The present invention, however, is not limited to football helmets. The broad inventive concepts described herein may be applied to protective helmets for other sports as well, including but not limited to hockey, lacrosse, bicycling, baseball, and other endeavors such as motorcycling, snow sports, and even horseback riding, anywhere a helmet is used for protecting the head from impacts. But in these other endeavors (except perhaps hockey) helmet-to-helmet collisions are non-existent. So there may be a philosophical difference in how the helmet should best function.

In a football helmet-to-helmet collision, even when one player is running at top speed, the head-neck pendulum contributor is kept by the energy absorbing linear compliance of most current prior art helmets below the threshold concussion level of 5,500 rad/sec$^2$, yet it may be close. So it is very important that a large top-of-the-neck contributor not be added in additive cases, but it is far less important if a large top-of-the-neck contributor is not being subtracted in subtractive cases. Thus it makes sense in football helmets where the impact speed is somewhat limited to reduce the top-of-the-neck contributor to the head angular acceleration at all times (as is accomplished with the first preferred embodiment), whether it is being added or being subtracted. But that is not the case for the other applications, where a cyclist could be thrown over the handlebars at very high speed, or a jockey could be thrown off his horse at very high speed, or skier could be knocked off his skis at very high speed, so when they all impact the ground their helmets should reduce the top-of-the-neck contributor to their head's angular acceleration only if they happen to impact in such a way that it would add to the head-neck-pendulum contributor. If they were to impact the ground or some other object in such a way that it would subtract from the head-neck pendulum contributor, they might need that extra now-protecting subtractive top-of-the-neck contributor not to be reduced. The previous football example provides a clue as to how the helmet can "know" whether the top-of-the-neck contributor will be adding or subtracting in a given impact, and as a result know whether to reduce the top-of-the-neck contributor, or not. Incredibly, this does not involve the use of any sensors or computer chips—it involves just a novel design modification to the liner.

All the above applications are non-repetitive impact applications, so the modified liner does not need to be of the automatic return type previously described for football and illustrated by the above described first preferred embodiment, but instead it can be the manual return type, wherein following an impact the user can, himself or herself return the outer shell to its initial position relative to the head cap. In a second preferred embodiment, hereinafter described, the liner provides that capability and reduces the top-of-the-neck contributor only when the nature of the impact makes it additive and the same liner does not reduce the top-of-the-neck contributor when the nature of the impact makes it subtractive. Thus a helmet in accordance with the second preferred embodiment would reduce brain injury as much as possible in either case. What is being accomplished in both cases is the maximum reduction in total resultant head angular acceleration for the given impact.

By contrast, some other helmet patents which aim to address those same non-repetitive but potentially high impact applications, claim to recognize the negative effect of high total resultant head angular acceleration on the brain, but seem not to recognize the two separate contributors to that resultant head angular acceleration as described in the present application, and so they attribute most or all of that angular acceleration to what is described herein as the top-of-the-neck contributor. Thus their solution to the problem is to always reduce the top-of-the-neck contributor regardless of the nature of the impact, apparently unaware that sometimes (when the two contributors are subtractive) their touted "more-protective" feature may actually be doing more harm than good. For example, take the case of a motorcyclist wearing one of the prior art helmets being thrown over the handlebars and impacting against the hard pavement head first. If his impact resembles what the defensive lineman (DL) of FIG. 14 sees (from his perspective, the pavement rushing up at him from his lower front), that's an additive situation for the top-of-the-neck contributor and so a helmet which always reduces that top-of-the-neck contributor will be helpful in reducing the total head angular acceleration. However, if his impact resembles what the offensive lineman (OL) of FIG. 14 sees (from his prospective, the pavement coming down on him from his top front), that is a subtractive situation for the top-of-the-neck contributor and so a helmet which always reduces the top-of-the-neck contributor will be hurtful to him, because it will not reduce his total head angular acceleration as much as a normal prior art helmet would without that special feature.

One of those helmet patents that describes a means to always reduce the top-of-the-neck contributor to head angular acceleration for an off-center impact is U.S. Pat. No. 6,658,671. It is widely licensed worldwide for skier protection, motorcyclist, and bicyclist protection, and equestrian protection. The licensees include many popular helmet providers such as POC, Scott, Sweet protection, TSG, RED, and Lazer sport. Referred to as "MIPS technology," for Multi-Directional Impact Protection System, the patent teaches, and the licensed helmet systems make use of a very low friction oil, teflon, or microsphere sliding layer located just inside the outer shell which enables the outer shell to rotate very easily in response to an off-center impact. (It rotates way too easily for any football application.) Also, these helmets are relatively close fitting, and with the sliding layer taking up some of that reduced (compared to football helmets) liner thickness, they tend to provide less protection against head linear acceleration and its resulting head-neck pendulum contributor. And finally, some embodiments of this patent are inherently "one-event" helmets, either because the foam in the liner does not totally return to its initial position, or there are permanently deforming rotation-limiting strips at the edges of the shells, or there are rotation-limiting strips that work by wedging into the foam, all of which should preclude its use for more than one impact.

Other similar patents and patent applications include the following: (1) U.S. Pat. No. 7,930,771 for a bicycle helmet application teaches a helmet with an inner layer for contacting the head, and an intermediate layer made of anisotropic foam material to provide some tangential compliance. All of the foams cited are rigid or semi-rigid foams which may not be fully returnable to the pre-impact condition and therefore should be for one impact only. (2) US patent application US 2002/0023291 A1 for a bicycle helmet application teaches a helmet having multiple layers that include an inner polyurethane layer, a gel layer, a polyethene layer, and an outer polycarbonate layer. According to the application, the gel layer allows for tangential relative motion but how the gel stays in place and enables a return to the initial position after an impact is not explained or claimed. (3) European patent application EP 1142495 A1 for a motorcycle or racecar helmet application teaches ten embodiments. In embodiments 1 thru 8 and 10, rotational slippage occurs along a spherical surface between inner and outer sections of the liner. In embodiment 9, the slip surface is non-spherical in order to inhibit excess relative rotation. In none of the embodiments are the inner and outer shells returnable to their pre-impact position. (4) International patent application WO2004/032659 A1 for a recreational sports and bicycle application teaches a helmet with two basic embodiments. In one embodiment two rigid foam sections form a spherical surface and between them is an intermediate layer which may be a distensible flexible envelope containing a silicone fluid, an oil, a gel, or solid spherical particles to enable tangential motion between the inner and outer surfaces of the bladder, or alternatively a gel layer may replace the bladder. The second embodiment shows a tangential relative motion enabling layer (or layers) positioned right below a spherical outer shell. No returnability mechanisms to the initial position are discussed. Also in many of the described helmet patents or applications, the indicated type of foam used in the liners is not one that fully returns to its initial shape following an impact. Plus in most cases the thickness of the foam is less than with current football helmets, so the linear acceleration attenuation and the resulting reduction in the head-neck pendulum angular acceleration may be insufficient to prevent concussions especially when the impact is large, as it might be for the intended applications.

Finally, none of the above patents and patent applications discuss the possibility that, depending upon the nature of the impact, it might be desirable or even possible for the helmet to be able to limit its rotational or tangential compliance in those specific high impact situations where the top-of-the-neck rotational contributor would subtract from the head-neck pendulum contributor in order to achieve less total resultant head angular acceleration for the user.

Figure 15:
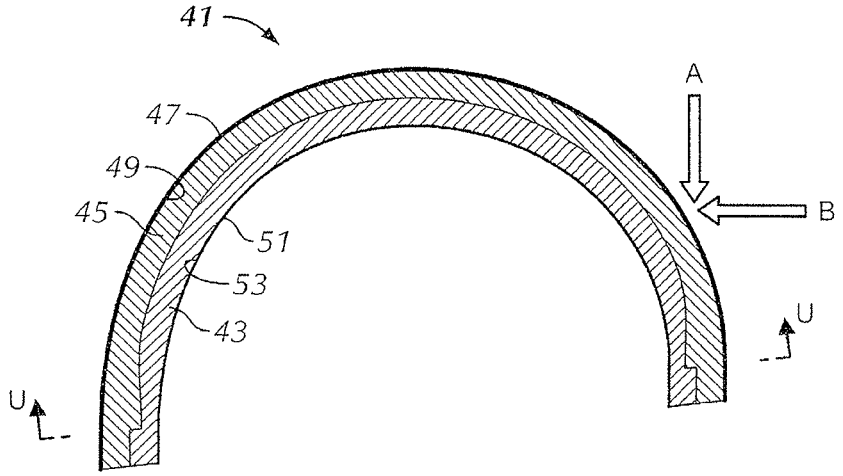
FIG. 15 is a vertical midsagittal plane cross sectional elevational view taken along section line W-W of FIG. 16 (see below) of the outer shell, a two part liner, and head cap of a manual return type helmet in accordance with a second preferred embodiment of the present invention.
Figure 16:
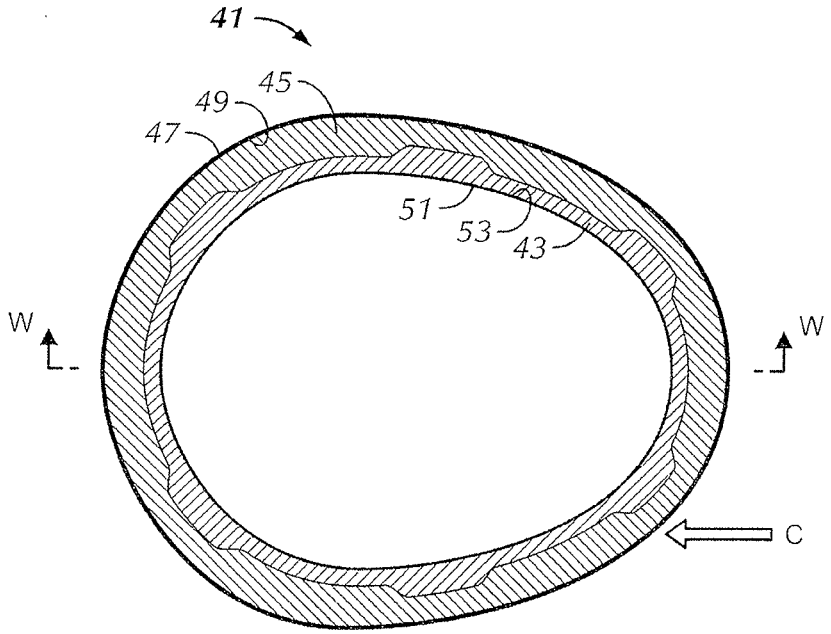
FIG. 16 is an approximate transverse plane cross sectional top plan view taken along section line U-U of FIG. 15 of the outer shell, two part liner, and head cap of the manual return type helmet of FIG. 15.

By contrast, the second preferred embodiment of the present invention does manage to accomplish that unique feat through its novel design. FIG. 15 and FIG. 16 are cross sectional views of a helmet 41, which has a flexible foam inner liner portion 43 and a flexible foam outer liner portion 45 of similar thickness, and wherein the inner portion nests within the outer portion in one preset initial pre-impact relative position. The basic shape of the mating surface of the two liner portions 43, 45 need not be perfectly spherical but is generally spheroid or ellipsoid, yet can still slip in response to a non-centered impact because of the flexibility of the foam materials. The outer surface of the outer foam portion 45 is adhered to the inner surface of the outer shell 47 with an adhesive layer 49, while the inner surface of the inner foam portion 43 is adhered to the outer surface of the head cap 51 with an adhesive layer 53. FIG. 15 is a vertical plane section WW (midsagittal plane) showing the outer shell 47, two-portion liner 43, 45, and head cap 51, and FIG. 16 is an approximate transverse plane section near the e.g. of the head along line UU, showing the outer shell 47, two-portion liner 41, 43, and head cap 51. For simplicity sake, not shown in either figure is anything interior to the head cap 51 or otherwise attached to it such as a chin strap, jaw strap, or sub-liner, or exterior to the outer shell 47 such as a face shield.

The outer foam portion 45 shown in both FIG. 15 and FIG. 16 preferably contains six horizontally oriented regions approximately evenly spaced around the periphery, each about 3 inches wide and spaced about 1 to 1½ inches from each other by six intermediate regions. Starting about 0.6 inches above the aforementioned transverse plane the six 3 inch wide regions gradually taper radially inwardly about 0.2 inches (sloping ~0.33 in/in) as they extend downwardly toward the rim, then suddenly they return to the original mating radius of the intermediate regions near the indicated transverse plane UU (FIG. 16), thereby creating six shelves.

The inner foam portion 43 preferably contains six matching horizontally oriented regions with matching width and positioning and matching gradual inwardly taper and sudden outward shelf-forming feature of the outer foam portion 45. Also for both the outer and inner portions 43,45 of the liner, starting approximately a half inch in from each end of the six 3 inch wide horizontal regions, they gradually taper outwardly toward the mating radius of the intermediate regions at both ends. The key features are the matching gradual tapers and mating shelves, herein 0.2 inch wide, in the six nearly 3 inch long shelves. But other numbers and other positions and other dimensions that accomplish essentially the same functions (to be described in the subsequent paragraphs) are also feasible. Note that as a modification to the above described second preferred embodiment, there may be one or more similar additional mating horizontal regions located above the ones described, but typically proportionally smaller in dimension.

Both the shape and the locations of the six horizontal regions are what give the helmet 41 the ability to reduce the top-of-the-neck rotational contributor to total head angular acceleration for impacts where the top-of-the-neck contributor would be additive to the head-neck pendulum contributor, and at the same time to not reduce the top-of-the-neck rotational contributor for impacts where the top-of-the-neck contributor is subtractive with the head-neck pendulum contributor and therefore helpful in limiting the total head angular acceleration. The key functional features are the flat bottoms (or shelves) of the horizontal regions along with their tapered sides and tapered tops.

Three potential non-centered high impact situations are herein analyzed and these are illustrated in FIGS. 15 and 16, impacts A and B in FIG. 15 and impact C in FIG. 16.

Impact A could be of a motorcyclist hurtling forward at 40+ MPH over the handlebars and striking the pavement on the upper forehead area of his helmet while his upper body is oriented slightly downward so the impact is directed along vector A in FIG. 15. From the normal force he would experience a large (backward) CCW head-neck pendulum angular acceleration contributor proportional to approximately A $\cos^2 45°$, and the normal force would also push the outer shell 47 and outer liner portion 45 inwardly toward the lower left of the figure. From the tangential force he would experience a large (forward) CW top-of-the-neck rotational angular acceleration contributor which is proportional to approximately A cos 45°. This contributor still exists because the outer foam portion 45 of the liner is getting crushed into the inner foam portion 43 of the liner in the right half of the figure and that now precludes the outer portion 45 of the liner from slipping downwardly past the inner portion 43 of the liner at their shared shelf interface location. It is the shelf-like nature of the interface that causes it to act like a one-way abutment, especially when the two liner portions are being pushed into one another. That enables almost all the top-of-the-neck CW rotational contributor to be subtracted from the head-neck pendulum CCW contributor for a much reduced total head angular acceleration. Notice that the motorcyclist impact herein described is analogous to the current prior-art helmet impact situation for the offensive lineman (OL) depicted in FIG. 14. Had the motorcyclist been wearing a MIPS helmet, the now protective (for this particular case) top-of-the-neck rotational contributor could have been much reduced, and the high speed motorcyclist could therefore have suffered greater total head angular acceleration and brain trauma as a result.

Impact B could be of the same motorcyclist hurtling forward at 40+ MPH, but this time he catches a heavy horizontal tree limb, with the impact occurring against his upper forehead area as shown at the right in FIG. 15 being directed along vector B while he is still oriented in an upward upper body orientation. So from the normal force he would experience a large (backward) CCW head-neck pendulum angular acceleration contributor proportional to approximately B $\cos^2 45°$ that would force the outer shell 47 and outer liner portion 45 inwardly toward the lower left of the figure. And from the tangential force he'd experience a large (also backward) CCW top-of-the-neck rotational angular acceleration contributor which is proportional to approximately B cos 45°. If the outer liner portion 45 could not slip relative to the inner liner portion 43 the two contributors would add unabated, yielding a high total head angular acceleration. But fortunately, because of the gentle taper just above the shared shelf location in the region near where the outer and inner helmet liner portions 43,45 are being crushed together at the right, the outer liner portion 45 can slip upwardly CCW relative to the inner liner portion 43. And at the back of the helmet (the opposite left hand side of the figure), the outer liner portion 45 has moved radially away from the inner liner portion 43 thereby disengaging in the shelf region and the outer liner portion 45 can move downward CCW relative to the inner liner portion 43. Thus the additive CCW top-of-the-neck contributor has been automatically decoupled from the head by the slipping, and only a much reduced top-of-the-neck contributor is added to the head-neck pendulum contributor for a much reduced total head angular acceleration.

Impact C depicted in FIG. 16 is much the same as the non-centered impacts depicted in FIG. 9 and FIG. 12. The impact is still in the same approximate transverse plane as the c.g. of the head, but now the impact, still off-center at the right-front, is directed straight back as shown. The situation could be of the above high speed motorcyclist, now impacting head first against a suddenly stopped, sideways-turned edge of his own windscreen. From the normal force he would experience a large (backward, toward the left rear of his head) head-neck pendulum angular acceleration proportional to approximately C cos 45°, the motion occurring in a vertical plane, and the normal force would also push the outer shell 47 and outer liner portion 45 toward the left rear of his head (the top left of the figure), causing no relative slippage. But from the tangential force he would experience a large CW top-of-the-neck rotational angular acceleration about his head's vertical axis that would be approximately proportional to C cos 45°. If the outer liner portion 45 were not able to slip in the transverse plane relative to the inner liner portion 43 the two angular accelerations would add approximately as the square root of the sum of the squares, yielding a high total head angular acceleration. But fortunately, because of the gentle taper at the ends of the 3 inch wide horizontal regions, the outer liner portion 45 is able to slip against the inner liner portion 43 and the so the transverse plane angular acceleration is not fully transmitted to the head to become one of the "squares" in the above square root of the sum of the squares relation, thereby reducing the otherwise high total head angular acceleration.

In each of the above discussed three impact scenarios there was slippage or at least the possibility of slippage between the outer liner portion 45 and the inner liner portion 43 (note that with impact A, slippage may have occurred at the side opposite the impact). So following the impact and before any reuse the outer shell 47 and its attached outer liner portion 45 must be manually returned to their initial positions relative to the head cap 51 and its attached inner liner portion 43. That process is straightforward, since in the approximate correct initial position, there is only one way the two liner portions 43, 45 can slide back into place. That is in contrast to other helmets with foam liners that may not fully return to their initial shape following an impact, in which case the user might unknowingly continue to wear the helmet although its performance might now be compromised.

A key purpose of the present invention is to reduce concussions on the football field and elsewhere by reducing the resultant peak head angular acceleration for the helmet wearer. But there are two interrelated questions that must be answered. The first question is, to reduce the resultant peak head angular acceleration to what level? That question has already been answered by the second study that was herein presented. And the second question is, to accomplish that level of reduction in response to what level and type of impact? Based upon the answers to the second question, there need to be numerical performance criteria specified that are at least partially met in order to achieve a level of concussion reduction that is significant. The following paragraph is helpful in answering the first part of the second question about what the level of impact might be.

In a recent interview, the manager of R&D for one of the largest football helmet manufacturers said that based on his own careful analysis of NFL films, 17.5 MPH (miles per hour) is the mean helmet-to-helmet velocity at which concussions occur, meaning it is the closing velocity for a 50% probability of concussion. By using 40 yard dash numbers for comparison, 17.5 MPH is 7.8 meters/second, and 40 yards is 36.6 meters, and so dividing 36.6 by 7.8 would yield a time of 4.69 seconds for a 40 yard dash. That is at or close to top speed for most football players, so it seems his 17.5 MPH number could make sense. The R&D manager then used an impact test rig to demonstrate a 17.5 MPH helmet-to-helmet collision of two instrumented dummy heads wearing the latest helmets and the interviewer described the impact as sounding like a gunshot. Based on the gathered internal accelerometer data the SI (severity index) was computed by the test rig software to be 432. If one assumes a 10 millisecond half sine acceleration waveform the corresponding peak head linear acceleration can be backed out, and it comes to 98 Gs. Even if all of that acceleration were in the transverse plane containing the c.g. of the head, that would translate to a head-neck pendulum peak angular acceleration of just 4,733 rad/sec$^2$ based upon an 8 inch distance between the head e.g. and the lower neck pivot. In the previously cited (above) high school study, the mean peak head linear acceleration for the 13 concussion impacts was 105 Gs, which reassuringly is not too dissimilar (within about 7%) from the computed 98 Gs for the above 17.5 MPH impact, thus tending to confirm the R&D manager's insight. But for the high school data, the concussion impacts had a mean peak head angular acceleration of 7,229 rad/sec$^2$, and therefore those impacts required an additional top-of-the-neck contributor as well. If the impacts were located at the transverse plane containing the c.g. of the head but were directed on average at an angle of 45° from it, the corresponding head-neck pendulum contributor could have been less than 3,600 rad/sec$^2$, so the contribution from the top-of-the-neck contributor for the 13 concussion impacts was likely on average another 3,600 rad/sec$^2$ if coplanar and purely additive, and likely over 6,000 rad/sec$^2$ if at right angles to the head-neck pendulum plane, in order to reach a mean peak total head angular acceleration level of 7,229 rad/sec$^2$.

In either case, it can be concluded that if sufficient circumferential compliance had been added to the high school players' helmet liners to reduce the top-of-the-neck rotational contributor to half the above values it would have brought the mean total head angular acceleration level below the concussion threshold of 5,500 rad/sec$^2$, and thereby would have eliminated at least half of the concussions—there were no concussions from any of the 53,563 impacts with angular accelerations below 5,500 rad/sec$^2$.

Using the above paragraphs as a guide, if a closing velocity of 7.8 m/sec between two instrumented helmeted heads is used as the basis of a helmet-to-helmet impact test, and if the impact is such that the closing velocity vector is 45 degrees off-center to represent a typical impact, which in reality could be anywhere from 0° representing a centered impact to 90° representing a grazing impact, and if the measured resultant peak head angular acceleration is less than 5,500 rad/sec$^2$ as a result of both the radial and circumferential compliance of the liner, that could represent at least a 50% potential concussion reduction for the particular 45° off-center impact location and direction used in the test. The greater the number of different 45° off-center locations and directions for which the resultant peak head angular acceleration turns out to be 5,500 rad/sec$^2$ or less, the more likely the total concussion rate will have a demonstrated potential for a 50% reduction or more.

The same logic can be utilized in what has become the standard test for helmets which involves dropping an instrumented helmeted head a set distance onto an anvil having a flat surface with a half inch polyurethane elastomer covering. The standard drop distance for football is 60 inches to obtain a closing speed of 5.5 m/sec at impact. The obvious question is: how equivalent is this to a helmet-to-helmet impact with a closing speed of 7.8 m/sec? It is completely intuitive to see that a car crashing into an immoveable wall at 30 MPH is exactly equivalent to the car crashing head-on into a like car at a combined closing speed of 60 MPH. With that analogy, one may conclude that a drop onto an anvil at 3.9 m/sec would be more equivalent to the 7.8 m/sec helmet-to-helmet collision. But the half inch polyurethane elasomer covering makes a big difference, and the extra give it provides indeed does make the 5.5 m/sec closing speed against the anvil fairly equivalent to the 7.8 m/sec helmet-to-helmet impact. For supporting evidence, in the cited interview above, the R&D manager also conducted a 5.5 m/sec impact velocity test against a standard anvil and came up with similar results for the measured (and computed) SI index. In standard tests the drop velocity vector is always normal to the anvil surface. However, in the equivalent off-center test herein proposed, the drop velocity vector must be at 45° to the anvil surface. And since the drop velocity vector is always vertical, the anvil must be mounted such that its covered impact surface is 45° from both true vertical, and thus true horizontal too.

Based on the previously cited data, calculations, and discussions, a concluding summation can be made regarding the novel teachings of the present specification and novel features of the present invention, and what performance criteria should be achieved and achievable as a result. The present invention specifically addresses concussion-reducing helmets for sports and activities where impacts to the helmet can be numerous and repetitive, such as football, hockey, and lacrosse, as well as helmets for sports and activities where helmet impacts are rare but impact velocities can be large, such as motorcycling and cycling, snow sports, and equestrian sports. A major teaching of the specification is that the linear acceleration of the head is not the direct cause of concussions, yet is still a key factor. The teaching is that the direct cause is the angular acceleration of the head, and that this has two contributors: a head-neck pendulum contributor which arises from the transverse linear acceleration and is driven by the horizontal coordinate of the normal force on the helmet, and a top-of-the-neck rotational contributor which is driven by the tangential force on the helmet in an off-center collision. Depending upon the location of the impact on the helmet, and its direction, the two contributors may, if in the same plane either directly add or directly subtract, or if in perpendicular planes add approximately as the square root of the sum of the squares. Football has both the most concussions and the most data relating measured head accelerations to concussions. One set of field data of 54,247 impacts found a head peak angular acceleration threshold of 5,582 rad/sec$^2$, below which occurred no concussions and above which the concussion rate was 2%. The same data reveals a mean head peak angular acceleration level of 7,222 rad/sec$^2$ for the concussive impacts. An analysis of the data indicates that on average half or more of the concussive angular acceleration was from a top-of-the-neck additive contributor, and that if hypothetically one had reduced that contributor by at least half by adding circumferential compliance to the liners of the prior art helmets while maintaining their radial compliance (the present invention requires and provides for both) one could have reduced the concussions by at least half. Combining information from another source, the unknown mean concussive closing velocities of the above study are shown to be consistent with a helmet-to-helmet closing velocity of 7.8 m/sec and an impact velocity of 5.5 m/sec against a polyurethane elastomer covered steel anvil in a 60 inch drop test. Thus it is meaningful to use these standard impact tests and speeds, but to impact at 45° off-center to excite the top-of-the-neck contributor (not excited by current centered tests) and do so in a way that it adds to the head-neck pendulum contributor. Then mean resultant head angular acceleration levels below 7,200 rad/sec$^2$ would be evidence of improvement and mean levels below 5,500 rad/sec$^2$ would be evidence of substantial improvement. The first preferred embodiment is for the cited repetitive impact applications, and the liner 8 automatically returns the outer shell 4 to its initial position relative to the head cap 6 (and head) after each impact. The second preferred embodiment is for those cited applications with rare but potentially high speed impacts, and the liner enables the user to manually (and completely) return the outer shell 47 and head cap 51 to their initial relative position following an impact. This is in contrast to some current helmets which employ elements that may suffer at least a slight permanent set following an impact and thus the user may unknowingly continue to use it although its performance might be impaired as a result. The first preferred embodiment liner 8 always exhibits circumferential compliance for maximum reduction of the top-of-the-neck contributor, even when the nature of the impact causes the two contributors to be subtractive. However, the second preferred embodiment's unique two piece liner design exhibits circumferential compliance except when the nature of the impact causes the two contributors to be subtractive. From the motorcyclist example (Impact A), that allows a large top-of-the-neck contributor to remain and subtract from the head-neck pendulum contributor when the latter might be very large due to a high speed impact against the ground or other immovable object. For football, the head neck pendulum contributor is rarely large enough by itself to cause a concussion, so when the nature of the impact is such that the two contributors are subtractive, subtracting a large top-of-the-neck contributor is not necessary. This should hold true for hockey and lacrosse as well, where the hits aren't helmet-to-helmet but are hits from opposing sticks and elbows, and in the case of hockey impacts against the wooden boards (and attached glass) which have a lot of give.

The present invention is not limited to the types of helmets cited herein. The broad inventive concepts described herein may be applied to protective helmets of all sports and activities, even certain military helmets, anywhere a helmet is used for protecting the head from impacts. Also, the invention is not limited to the first preferred embodiment described herein where the circumferential compliance and linear (radial) compliance of the helmet liner 8 was obtained by segmenting the liner's foam into a multitude of narrow radial columns 24. Nor is it limited to the second preferred embodiment described herein where the circumferential compliance was obtained by the slipability between the two portions of the liner. The basic inventive principle is to employ a liner having both angular (circumferential) compliance and linear (radial) compliance, and having the ability to enable a full return to the pre-impact condition following an impact, and other structures or methods of achieving such dual compliance of sufficient degree and full return-ability would still come under the broad teachings of the present invention. And in the second preferred embodiment case, there is the ability of the liner to automatically preferentially manifest or not manifest that circumferential compliance based on the nature of the impact. Other structures or methods of achieving the necessary dual liner compliance and automatic preferential manifestation of the circumferential compliance based upon the nature of the impact and full return-ability following an impact according to the present invention are also covered under the broad teachings of the present invention. For both cases, the other structures or methods may include, but are not be limited to, the use of a cup-shaped bladder located between and attached to the head cap and outer shell, wherein the bladder may have its own elastic properties for full return-ability and may contain other elastic and energy absorbing elements such as compressible/extensible finger-like elements, fibrous elements, metal spring elements, polymer spring elements, elastomer spring elements, air spring elements, curved bristle-like elements, stretchable filament elements, viscous fluid elements, frictional filler elements, inertial filler elements, density reducing filler elements, and the like, plus the use of any of the above elements without the bladder, as long as the liner enables the head cap and the outer shell to be returned to their initial pre-impact relative position following an impact, either automatically or manually, so as to be ready for another impact.

Finally, although the first preferred embodiment and the second preferred embodiment of the improved helmet system have been described in significant detail for the helmet applications addressed herein, not just alternate arrangements but other applications which are still within the scope of the present invention may be feasible. It will also be appreciated by those skilled in the art that alternate uses may be found that differ from the proposed use, and changes or modifications could be made to the above-described embodiments without departing from the broad inventive concepts of the invention. Therefore it should be appreciated that the present invention is not limited to the particular use or particular embodiments disclosed but is intended to cover all uses and all embodiments within the scope or spirit of the described invention.

I claim:

1. A protective helmet for repetitive impact applications, the helmet comprising:

a hard impact-resistant outer shell having an inner surface, a head-follower head cap located within the outer shell, the head cap being of similar shape to the outer shell adapted to surround at least a portion of a cranial part of a wearer's head and having an outer surface facing the inner surface of the outer shell, the inner surface of the outer shell being spaced from the outer surface of the head cap, an adjustable chin strap assembly having an attachment/detachment device for securing said adjustable chin strap assembly to the head cap, enabling said wearer to secure and unsecure the helmet to said wearer's head, a liner between the head cap and outer shell, said liner exhibiting energy absorbing linear compliance and energy absorbing angular compliance, the liner being comprised of a plurality of side-by-side, radially-oriented, elastically compliant foam columns, each column of said plurality of columns comprising a bottom surface directly adhered to the outer surface of the head cap and each column of said plurality of columns comprising a top surface directly adhered to the inner surface of the outer shell, said plurality of columns filling a space between the head cap and outer shell and each column of said plurality of columns comprising a side surface in direct slidable contact with a side surface of an adjacent column, said protective helmet having an initial pre-impact position, a centered impact position, and an off-centered impact position, said initial pre-impact position comprising the radially oriented columns being in an unbent condition, a first point on the head cap outer surface is aligned with a corresponding first point on the outer shell inner surface, a second point on the head cap outer surface is aligned with a corresponding second point on the outer shell inner surface, a third point on the head cap outer surface is aligned with a corresponding third point on the outer shell inner surface, and a fourth point on the head cap outer surface is aligned with a corresponding fourth point on the outer shell inner surface, said centered impact position comprising both said outer shell and said head cap moved away from said initial pre-impact position, the columns between said third point on the head cap and the fourth point on the head cap are compressed, the columns between the first point on the head cap and the second point on the head cap are stretched, the columns between the second point on the head cap and the third point on the head cap are deformed into S curves, and the columns between the fourth point on the head cap and the first point on the head cap are deformed into S curves, with said first and second points on the outer shell inner surface displaced with respect to said first and second points on the head cap outer surface and said third and fourth points on the outer shell inner surface displaced with respect to said third and fourth points on the head cap outer surface, the top surfaces of each of the foam columns between the first and second points on the outer shell inner surface displaced with respect to the bottom surfaces of each of the foam columns between the first and second points on the head cap outer surface portion, each of the foam columns between the second and third points and each of the foam columns between the first and fourth points being bent and in an S curve, adjacent foam columns of the plurality of columns in an S curve, said off-centered impact position comprising both said outer shell and said head cap are moved away from both said initial pre-impact position and said centered impact position, the outer shell inner surface transversely displaced with respect to the head cap outer surface in a plane extending through first, second, third and fourth points on the head cap outer surface, the foam columns between the third and fourth points on the head cap are compressed, the foam columns between the first and second points are stretched, and all of the foam columns of the plurality of foam columns are deformed into S curves, with the foam columns therein being bent and in an S curve, and after an impact the elastic foam columns collectively contribute to the liner automatically returning the outer shell to said pre-impact position with the head cap.

2. The helmet as recited in claim 1 further comprising an inner conformal sub-liner adapted to be located between at least a portion of the head cap and the wearer's head.

3. The helmet as recited in claim 2 wherein the inner conformal sub-liner is constructed of a material selected from the group consisting of at least one of open cell foam padding, air breathing fabric padding, air breathing fabric mesh, and air bladders.

4. The helmet as recited in claim 1 wherein the plurality of foam columns have an average slenderness ratio of between 3 and 30.

5. The helmet as recited in claim 1 wherein elastically compliant foam columns are constructed at least in part of viscoelastic foam whereby compression of the viscoelastic foam during an impact absorbs linear energy.

6. The helmet as recited in claim 1 wherein elastically compliant foam columns are constructed of open cell foam to provide greater side surface friction between rubbing neighboring S curve bending columns during impact, resulting in greater energy absorption.

7. The helmet as recited in claim 1 wherein the elastically compliant foam of the compressed columns is compressible by at least 60%.

8. The helmet as recited in claim 1 wherein the elastically compliant foam of the stretched columns is stretchable by at least 60%.

* * * * *